US010858145B2

(12) United States Patent
Spivey, Sr. et al.

(10) Patent No.: US 10,858,145 B2
(45) Date of Patent: Dec. 8, 2020

(54) CARRIER FOR CONTAINERS

(71) Applicant: Graphic Packaging International, Inc., Atlanta, GA (US)

(72) Inventors: Raymond R. Spivey, Sr., Mableton, GA (US); Colin P. Ford, Woodstock, GA (US); John Murdick Holley, Jr., Lawrenceville, GA (US); Ana Gonzalez, Barcelona (ES); Jon Thompson, Bristol (GB); Brian Smalley, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 831 days.

(21) Appl. No.: 15/399,283

(22) Filed: Jan. 5, 2017

(65) Prior Publication Data

US 2017/0190461 A1 Jul. 6, 2017

Related U.S. Application Data

(60) Provisional application No. 62/274,979, filed on Jan. 5, 2016.

(51) Int. Cl.
*B65D 5/54* (2006.01)
*B65D 71/64* (2006.01)
(Continued)

(52) U.S. Cl.
CPC ..... *B65D 5/5495* (2013.01); *B65D 5/02* (2013.01); *B65D 5/4266* (2013.01);
(Continued)

(58) Field of Classification Search
CPC ..... B65D 5/02; B65D 5/5495; B65D 5/4608; B65D 71/36; B65D 71/0022;
(Continued)

(56) References Cited

U.S. PATENT DOCUMENTS 1,120,752 A 12/1914 Smiley
1,896,326 A 2/1933 Northway-Ley
(Continued)

FOREIGN PATENT DOCUMENTS

CH 263456 8/1949
DE 88 14 144.6 1/1989
(Continued)

OTHER PUBLICATIONS

International Search Report and Written Opinion for PCT/US2017/012285 dated Apr. 21, 2017.
(Continued)

*Primary Examiner* — Chun Hoi Cheung
*Assistant Examiner* — Brijesh V. Patel
(74) *Attorney, Agent, or Firm* — Womble Bond Dickinson (US) LLP

(57) ABSTRACT

A carrier includes a front portion with a first plurality of panels and a back portion with a second plurality of panels. The first plurality of panels at least partially surrounds a front interior space for receiving at least one container and includes a front panel, a front central panel, and at least one front side panel. The second plurality of panels at least partially surrounds a back interior space for receiving at least one container and includes a back panel, a back central panel, and at least one back side panel. The front central panel and the back central panel are separably connected at a line of weakening and are at least partially in face-to-face contact in a first configuration of the carrier, the carrier is positionable to a second configuration wherein the front portion and the back portion are at least partially separated at the line of weakening.

20 Claims, 22 Drawing Sheets

(51) Int. Cl.

| | |
|---|---|
| ***B65D 5/02*** | (2006.01) |
| ***B65D 5/42*** | (2006.01) |
| ***B65D 5/468*** | (2006.01) |
| ***B65D 71/36*** | (2006.01) |

(52) U.S. Cl.

CPC ..... *B65D 5/4275* (2013.01); *B65D 5/4608* (2013.01); *B65D 71/0048* (2013.01); *B65D 71/36* (2013.01); *B31B 2241/001* (2013.01); *B65D 2571/0066* (2013.01); *B65D 2571/00438* (2013.01)

(58) Field of Classification Search

CPC ..... B65D 2571/00141; B65D 2571/00438; B65D 2571/00864

USPC ..... 206/181–188, 196, 193, 162, 173, 170, 206/174; 229/120.12, 120.04, 125.29, 229/117.01, 117.14–117.18, 241–242

See application file for complete search history.

(56) References Cited

U.S. PATENT DOCUMENTS 1,898,646 A 2/1933 Taylor
2,111,376 A 3/1938 Van Wingen
2,151,472 A 3/1939 Hubbard
2,222,211 A 11/1940 Arneson
2,225,822 A 12/1940 Crook
2,227,330 A 12/1940 Turner
2,312,846 A 3/1943 Olvey
2,331,312 A 10/1943 Dorfman
2,336,857 A 12/1943 Gies et al.
2,457,308 A 12/1948 Hall et al.
2,460,108 A 1/1949 Smith et al.
2,475,107 A 7/1949 Newsom
2,660,361 A 11/1953 Tyrseck
2,689,061 A 9/1954 Gray
2,721,001 A 10/1955 Hasselhoff
2,722,368 A * 11/1955 Gottsegen ..... B65D 33/10 383/6
2,758,774 A 8/1956 Grunert et al.
2,772,020 A 11/1956 Kramer
2,776,072 A 1/1957 Forrer
2,783,916 A 3/1957 Hodapp
2,844,294 A 7/1958 Williams
2,854,050 A 9/1958 Di Padova
2,875,942 A 3/1959 Wilson
2,989,221 A 6/1961 Butler
2,991,908 A 7/1961 Conescu
2,993,619 A 7/1961 Arneson
3,006,523 A 10/1961 Keith
3,029,977 A 4/1962 Arneson
3,053,411 A 9/1962 Struble et al.
3,101,880 A 8/1963 Peterson
3,128,906 A 4/1964 Forrer
3,135,457 A * 6/1964 Risucci ..... B65D 5/5495 229/120.011
3,158,312 A 11/1964 Simkins
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,385,430 A * 5/1968 Benzon-Petersen ..... B65D 5/5495 206/746
3,432,073 A 3/1969 Forrer
3,554,401 A 1/1971 Wood
3,624,790 A 11/1971 Stout
3,651,982 A 3/1972 Slevin
3,661,297 A 5/1972 Wood
3,664,494 A 5/1972 Mergens
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,732,976 A 5/1973 Bessett et al.
3,739,940 A 6/1973 Harrelson
3,754,680 A 8/1973 Wood
3,757,991 A 9/1973 Stout
3,784,053 A 1/1974 Stout
3,822,785 A 7/1974 Getz et al.
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
3,937,326 A 2/1976 Schick
4,000,813 A 1/1977 Stout
4,010,847 A 3/1977 Wood et al.
4,029,205 A 6/1977 Wood
4,105,154 A 8/1978 Meyers et al.
4,120,443 A 10/1978 Gardner et al.
4,138,052 A 2/1979 Torigian
4,153,158 A 5/1979 Graser et al.
4,171,046 A 10/1979 Bonczyk
4,187,944 A 2/1980 Wood
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,421,229 A 12/1983 Pan et al.
4,441,611 A * 4/1984 Sommariva ..... B65D 71/0085 206/431
4,450,956 A 5/1984 Wood
4,469,222 A 9/1984 Graser
4,480,746 A 11/1984 Wood
4,482,055 A 11/1984 Boyle
4,509,640 A 4/1985 Joyce
4,530,459 A 7/1985 Maroszek
4,544,092 A 10/1985 Palmer
4,577,799 A 3/1986 Oliff
4,591,090 A 5/1986 Collins et al.
4,610,349 A 9/1986 Schwartz et al.
4,621,766 A 11/1986 McClure
4,722,437 A 2/1988 Walsh
4,739,921 A 4/1988 Taub
4,770,294 A 9/1988 Graser
4,782,943 A 11/1988 Blackman
4,782,944 A 11/1988 Engdahl, Jr.
4,792,038 A 12/1988 Cooper
4,811,837 A 3/1989 Larizza
4,913,291 A * 4/1990 Schuster ..... B65D 5/5495 229/120.011
4,919,269 A 4/1990 Wright
4,927,009 A 5/1990 Stout
5,029,698 A 7/1991 Stout
5,040,672 A 8/1991 DeMaio et al.
5,072,876 A 12/1991 Wilson
5,076,492 A 12/1991 Tupes
5,123,588 A 6/1992 Harris
5,141,106 A * 8/1992 Adams ..... B65D 5/5495 206/256
5,161,732 A 11/1992 Clein et al.
5,167,325 A 12/1992 Sykora
5,178,268 A * 1/1993 Talley ..... B65D 5/5495 206/256
5,178,269 A * 1/1993 Evers ..... B65D 5/5495 206/256

(56) References Cited

U.S. PATENT DOCUMENTS 5,178,271 A * 1/1993 Adams ..... B65D 5/5495 206/256
5,180,056 A * 1/1993 Adams ..... B65D 5/5495 206/256
5,190,211 A 3/1993 Stoddard et al.
5,191,976 A 3/1993 Stout et al.
5,201,413 A * 4/1993 DeBlasio ..... B65D 5/5495 206/256
5,234,102 A 8/1993 Schuster et al.
5,246,113 A 9/1993 Schuster
5,251,748 A * 10/1993 Adams ..... B65D 5/5495 206/256
5,261,533 A * 11/1993 Adams ..... B65D 85/1072 206/261
5,282,348 A 2/1994 Dampier et al.
5,316,210 A 5/1994 Scullin
5,359,830 A 11/1994 Olson et al.
5,363,954 A 11/1994 Dampier et al.
5,400,901 A 3/1995 Harrelson
5,415,344 A 5/1995 Harrelson
5,427,242 A 6/1995 Oliff et al.
5,437,143 A 8/1995 Culpepper et al.
5,439,110 A 8/1995 Regan, II
5,458,234 A 10/1995 Harris
5,482,203 A 1/1996 Stout
5,484,053 A 1/1996 Harris
5,499,712 A 3/1996 Harrelson
5,518,111 A 5/1996 Stout
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,645,163 A * 7/1997 Werth ..... B65D 5/5495 206/192
5,649,620 A 7/1997 Harrelson
5,657,864 A 8/1997 Harrelson
5,657,865 A 8/1997 Harrelson
5,669,500 A 9/1997 Sutherland
5,680,930 A 10/1997 Stone
5,682,982 A 11/1997 Stonehouse
5,682,984 A 11/1997 Hoell et al.
5,682,985 A 11/1997 Plaxico et al.
5,695,051 A 12/1997 Hart
5,699,957 A 12/1997 Blin et al.
5,709,298 A 1/1998 Harris
5,765,685 A 6/1998 Roosa
5,772,030 A 6/1998 Baxter
5,775,487 A 7/1998 Harrelson
5,813,540 A 9/1998 Vollbrecht et al.
5,819,920 A 10/1998 Sutherland
5,826,783 A 10/1998 Stout
5,826,870 A 10/1998 Vulgamore et al.
5,848,686 A 12/1998 Dean
5,848,695 A 12/1998 Harris et al.
5,853,088 A 12/1998 Saulas et al.
5,855,316 A 1/1999 Spivey
5,868,252 A 2/1999 Oliff
5,871,090 A 2/1999 Doucette et al.
5,878,877 A 3/1999 Sutherland
5,884,756 A 3/1999 Holley, Jr. et al.
5,938,109 A 8/1999 Sainz et al.
5,941,377 A 8/1999 Hart et al.
5,947,273 A 9/1999 Dalrymple et al.
5,957,288 A 9/1999 Campbell
5,967,406 A 10/1999 Moorman
5,996,883 A 12/1999 Bates
6,003,665 A 12/1999 Stout
6,012,630 A 1/2000 Block
6,041,920 A 3/2000 Hart et al.
6,065,590 A 5/2000 Spivey
6,089,366 A * 7/2000 Cheng ..... B65D 85/305 206/192
6,112,977 A 9/2000 Sutherland et al.
6,131,729 A 10/2000 Eckermann et al.
6,155,962 A 12/2000 Dalrymple et al.
6,168,013 B1 1/2001 Gomes
6,176,419 B1 1/2001 Holley, Jr.
6,230,881 B1 5/2001 Collura
6,244,502 B1 6/2001 Hollar et al.
6,247,585 B1 6/2001 Holley, Jr.
6,250,542 B1 6/2001 Negelen
6,315,111 B1 11/2001 Sutherland
6,321,906 B1 11/2001 Wein
6,341,689 B1 1/2002 Jones
6,371,287 B1 4/2002 Jones et al.
6,386,369 B2 5/2002 Yuhas et al.
6,402,020 B1 6/2002 McClure
6,571,941 B2 6/2003 Holley, Jr.
6,695,137 B2 2/2004 Jones et al.
6,736,260 B2 5/2004 Gomes et al.
6,802,802 B2 10/2004 Woog
6,814,228 B2 11/2004 Sutherland
6,823,989 B2 * 11/2004 Wilder ..... B65D 5/4275 206/264
6,918,487 B2 7/2005 Harrelson
6,926,193 B2 8/2005 Smalley
6,938,756 B2 9/2005 Schuster
6,991,107 B2 1/2006 Harrelson
7,011,209 B2 3/2006 Sutherland et al.
7,025,197 B2 4/2006 Sutherland
7,070,045 B2 7/2006 Theelen
7,093,713 B2 8/2006 Sutherland
7,128,206 B2 10/2006 Kohler
7,134,547 B2 11/2006 Auclair
7,168,558 B2 1/2007 Harrelson
7,195,118 B2 3/2007 Sutherland
7,207,934 B2 4/2007 Schuster
7,234,596 B2 6/2007 Lebras
7,270,259 B2 9/2007 Sutherland
7,374,038 B2 5/2008 Smalley
7,448,492 B2 11/2008 Sutherland
7,472,791 B2 1/2009 Spivey, Sr.
7,475,778 B2 1/2009 Sutherland
7,552,820 B2 6/2009 Kohler
7,578,427 B2 8/2009 Durnin
7,604,116 B2 10/2009 Schuster
7,644,817 B2 1/2010 Sutherland
7,677,387 B2 3/2010 Brand et al.
7,717,321 B2 5/2010 Spivey, Sr. et al.
7,721,887 B2 * 5/2010 Hancock-Cooke ..... B62J 9/00 206/391
7,762,395 B2 7/2010 Sutherland et al.
7,762,397 B2 7/2010 Coltri-Johnson et al.
7,793,780 B2 9/2010 Smalley
7,793,821 B2 9/2010 Oliveira
7,823,721 B2 11/2010 Sutherland et al.
7,832,622 B2 11/2010 Spivey, Sr.
7,959,062 B2 6/2011 Auclair
8,020,695 B2 9/2011 Brand
8,127,980 B2 3/2012 Spivey, Sr. et al.
8,297,437 B2 10/2012 Smalley et al.
8,459,535 B2 6/2013 Brand
8,622,207 B2 1/2014 Smalley
8,628,000 B2 1/2014 Spivey, Sr. et al.
9,132,936 B2 9/2015 Kohler
9,415,915 B2 8/2016 Spivey, Sr. et al.
2002/0077236 A1 6/2002 Chalendar et al.
2002/0117407 A1 8/2002 Holley
2003/0080180 A1 5/2003 Holley et al.
2003/0111363 A1 6/2003 Theelen
2003/0159950 A1 8/2003 Jones et al.
2003/0213705 A1 11/2003 Woog
2004/0026269 A1 2/2004 Cuomo
2004/0050722 A1 3/2004 Schuster
2004/0094435 A1 5/2004 Auclair et al.
2004/0155098 A1 8/2004 Harrelson

(56) References Cited

U.S. PATENT DOCUMENTS

| | | | | |
|---|---|---|---|---|
| 2004/0245327 | A1 | 12/2004 | Oliff et al. | |
| 2005/0023331 | A1 | 2/2005 | Hirschey | |
| 2005/0067477 | A1 | 3/2005 | McClure | |
| 2005/0115843 | A1 | 6/2005 | Harrelson | |
| 2005/0167290 | A1 | 8/2005 | Sutherland | |
| 2005/0167292 | A1 | 8/2005 | Sutherland | |
| 2005/0173269 | A1 | 8/2005 | Lebras | |
| 2005/0189406 | A1 | 9/2005 | Welchel et al. | |
| 2005/0211577 | A1 | 9/2005 | Bakx | |
| 2005/0218014 | A1 | 10/2005 | Schuster | |
| 2005/0230273 | A1 | 10/2005 | Kohler | |
| 2006/0091024 | A1 | 5/2006 | Cuomo | |
| 2006/0148629 | A1 | 7/2006 | Cuomo | |
| 2006/0157545 | A1 | 7/2006 | Auclair | |
| 2006/0231440 | A1 | 10/2006 | Holley, Jr. | |
| 2006/0283926 | A1 | 12/2006 | Drunin | |
| 2007/0000980 | A1 | 1/2007 | Oliveira | |
| 2007/0017839 | A1 | 1/2007 | Sutherland | |
| 2007/0029212 | A1 | 2/2007 | Smalley | |
| 2007/0141208 | A1 * | 6/2007 | Nukuto | B62B 3/1472 426/129 |
| 2007/0151873 | A1 | 7/2007 | Schuster | |
| 2007/0170232 | A1 | 7/2007 | Spivey | |
| 2008/0017527 | A1 | 1/2008 | Cuomo | |
| 2008/0210581 | A1 | 9/2008 | Brand | |
| 2008/0265008 | A1 | 10/2008 | Holley | |
| 2009/0008273 | A1 | 1/2009 | Smalley | |
| 2010/0006458 | A1 | 1/2010 | Wilkins et al. | |
| 2010/0072086 | A1 | 3/2010 | Smalley | |
| 2011/0048975 | A1 | 3/2011 | Brand | |
| 2011/0132978 | A1 | 6/2011 | de Sousa | |
| 2012/0000913 | A1 | 1/2012 | Smalley et al. | |
| 2013/0256392 | A1 | 10/2013 | Kohler | |
| 2014/0291386 | A1 | 10/2014 | Ikeda | |
| 2015/0321816 | A1 | 11/2015 | Holley, Jr. | |

FOREIGN PATENT DOCUMENTS

| | | | |
|---|---|---|---|
| DE | 90 04 439 | | 6/1990 |
| DE | 91 11 941.3 | | 1/1992 |
| EP | 0 595 602 | | 5/1994 |
| EP | 0 822 150 | | 2/1998 |
| EP | 1 319 607 | | 6/2003 |
| EP | 1 852 359 | | 11/2007 |
| EP | 2 102 073 | | 9/2010 |
| FR | 1 427 897 | | 4/1966 |
| FR | 1 489 087 | | 7/1967 |
| FR | 1 497 652 | | 10/1967 |
| FR | 2 223 985 | | 10/1974 |
| FR | 2 626 256 | | 7/1989 |
| FR | 2 825 074 | | 11/2002 |
| GB | 434145 | | 8/1935 |
| GB | 926874 | | 5/1963 |
| GB | 2 198 709 | | 6/1988 |
| GB | 2 323 352 | | 9/1998 |
| JP | 62-62617 | | 10/1985 |
| JP | 62-130024 | | 8/1987 |
| JP | 1-73121 | | 5/1989 |
| JP | 5-7621 | | 2/1993 |
| JP | 7-125745 | | 5/1995 |
| JP | 9-142449 | | 6/1997 |
| JP | 11-130049 | | 5/1999 |
| JP | 2000-85754 | | 3/2000 |
| JP | 2000-238779 | | 9/2000 |
| JP | 2002-526346 | | 8/2002 |
| WO | WO 92/07772 | | 5/1992 |
| WO | WO 96/29261 | | 9/1996 |
| WO | WO 97/05026 | | 2/1997 |
| WO | WO 98/56684 | | 12/1998 |
| WO | WO 99/01356 | | 1/1999 |
| WO | WO 99/28198 | | 6/1999 |
| WO | WO 00/20288 | | 4/2000 |
| WO | WO 01/30659 | | 5/2001 |
| WO | WO 02/30764 | | 4/2002 |
| WO | WO 2004/014755 | | 2/2004 |
| WO | WO 2006/020525 | | 2/2006 |
| WO | WO 2008/089124 | | 7/2008 |
| WO | WO 2016/040262 | A2 | 3/2016 |
| WO | WO-2016054166 | A1 * | 4/2016 ..... B65D 71/0022 |

OTHER PUBLICATIONS

Supplementary European Search Report for EP 17 73 6305 dated May 9, 2019.

* cited by examiner

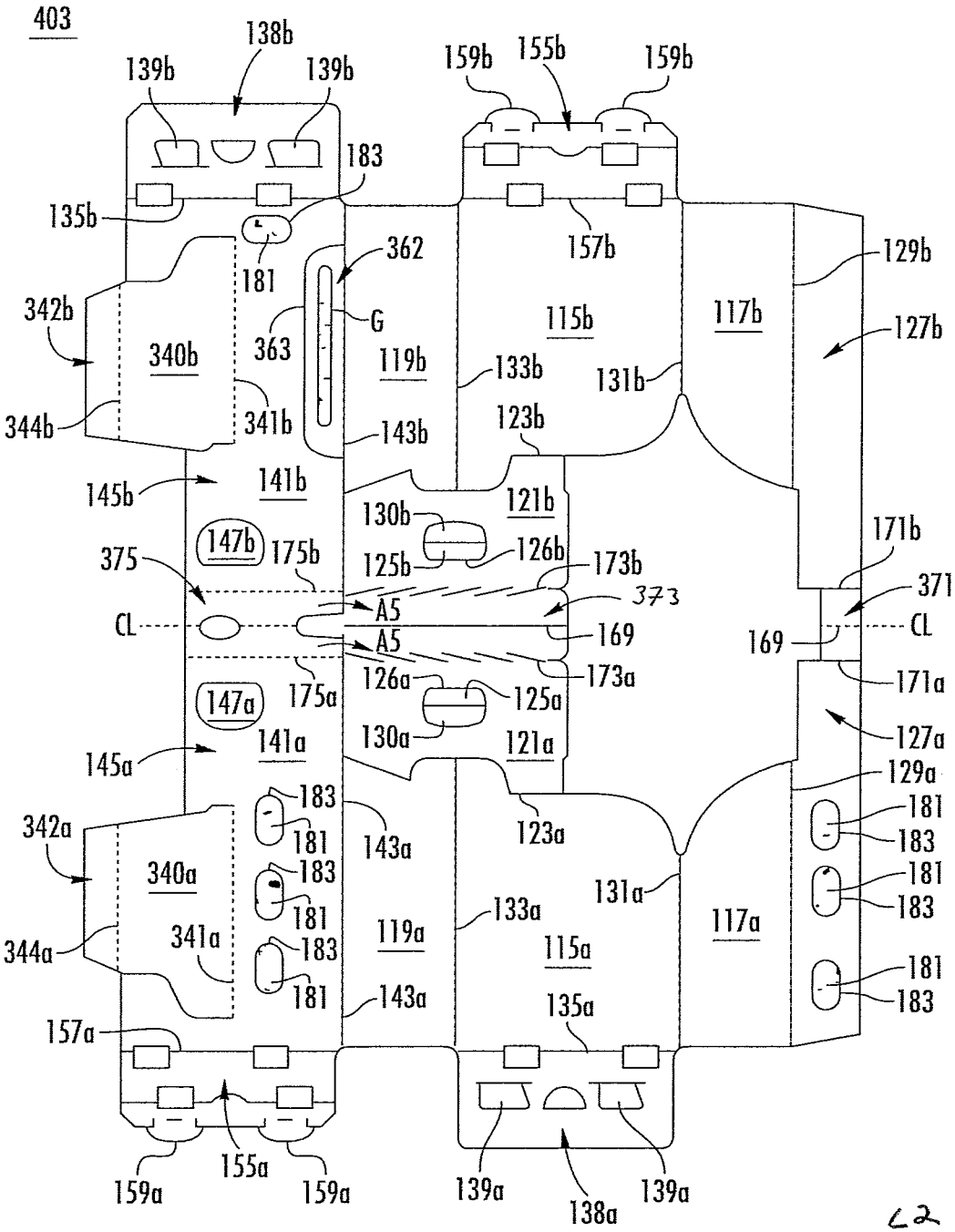
FIG. 18
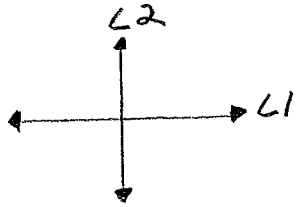

CARRIER FOR CONTAINERS

CROSS-REFERENCE TO RELATED APPLICATION

The present application claims the benefit of U.S. Provisional Patent Application No. 62/274,979, filed on Jan. 5, 2016.

INCORPORATION BY REFERENCE

The disclosure of U.S. Patent Application No. 62/274,979, filed on Jan. 5, 2016, is hereby incorporated by reference for all purposes as if presented herein in its entirety.

BACKGROUND OF THE DISCLOSURE

The present disclosure generally relates to carriers or cartons for holding and displaying containers. More specifically, the present disclosure relates to basket-style carriers that are separable into a first portion and a second portion.

SUMMARY OF THE DISCLOSURE

According to one aspect of the disclosure, a carrier for holding a plurality of containers is disclosed. The carrier comprises a front portion that comprises a first plurality of panels and a back portion that comprises a second plurality of panels. The first plurality of panels at least partially surrounds a front interior space for receiving at least one container of the plurality of containers and comprises a front panel, a front central panel, and at least one front side panel. The second plurality of panels at least partially surrounds a back interior space for receiving at least one container of the plurality of containers and comprises a back panel, a back central panel, and at least one back side panel. The front central panel and the back central panel are separably connected at a line of weakening and are at least partially in face-to-face contact in a first configuration of the carrier. The carrier is positionable to a second configuration wherein the front portion and the back portion are at least partially separated at the line of weakening.

According to another aspect of the disclosure, a blank for forming a carrier for holding a plurality of containers is disclosed. The blank comprises a front portion that comprises a first plurality of panels and a back portion that comprises a second plurality of panels. The first plurality of panels is for at least partially surrounding a front interior space of a front portion of the carrier when the carrier is formed from the blank and comprises a front panel, a front central panel, and at least one front side panel. The front interior space of the carrier is for receiving at least one container of the plurality of containers. The second plurality of panels is for at least partially surrounding a back interior space of a back portion of the carrier when the carrier is formed from the blank and comprises a back panel, a back central panel, and at least one back side panel. The back interior space of the carrier is for receiving at least one container of the plurality of containers. The front central panel and the back central panel are separably connected at a line of weakening and are for being in at least partial face-to-face contact in a first configuration of the carrier when the carrier is formed from the blank. The front portion of the carrier and the back portion of the carrier are positionable to a second configuration wherein the front portion of the blank and the back portion of the blank are at least partially separated at the line of weakening when the carrier is formed from the blank.

According to another aspect of the disclosure, a method for forming a carrier for holding a plurality of containers is disclosed. The method comprises providing a blank that comprises a front portion and a back portion. The front portion of the blank comprises a first plurality of panels comprising a front panel, a front central panel, and at least one front side panel. The back portion of the blank comprises a second plurality of panels comprising a back panel, at least one back side panel, and a back central panel foldably connected to the front central panel at a line of weakening. The method also comprises folding the first plurality of panels and the second plurality of panels into a first configuration of the carrier so that the first plurality of panels at least partially surrounds a front interior space of a front portion of the carrier and the second plurality of panels at least partially surrounds a back interior space of the carrier. The front central panel and the second central panel are in at least partial face-to-face contact in the first configuration of the carrier, each of the front interior space and the back interior space for receiving at least one container of the plurality of containers.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

FIG. 18 is a plan view of an outer surface of a blank for forming a carrier according to a fourth exemplary embodiment of the disclosure.

Corresponding parts are designated by corresponding reference numbers throughout the drawings.

DETAILED DESCRIPTION

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles) at least partially disposed within the carrier embodiments. In this specification, the terms "lower," "bottom," "upper," "top," "front," and "back" indicate orientations determined in relation to fully erected carriers.

Figure 1:
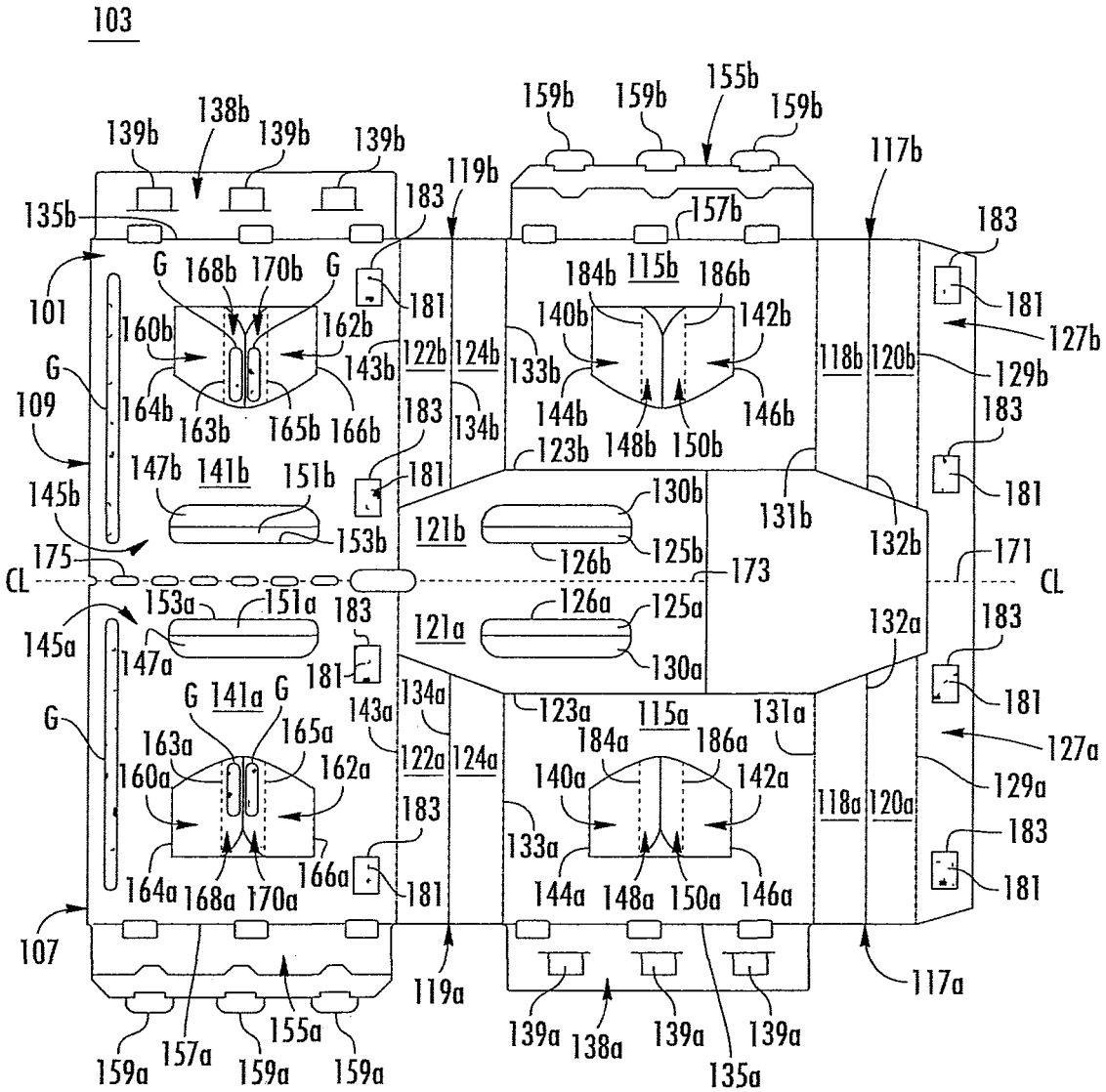
FIG. 1 is a plan view of an outer surface of a blank for forming a carrier according to a first exemplary embodiment of the disclosure.
Figure 7:
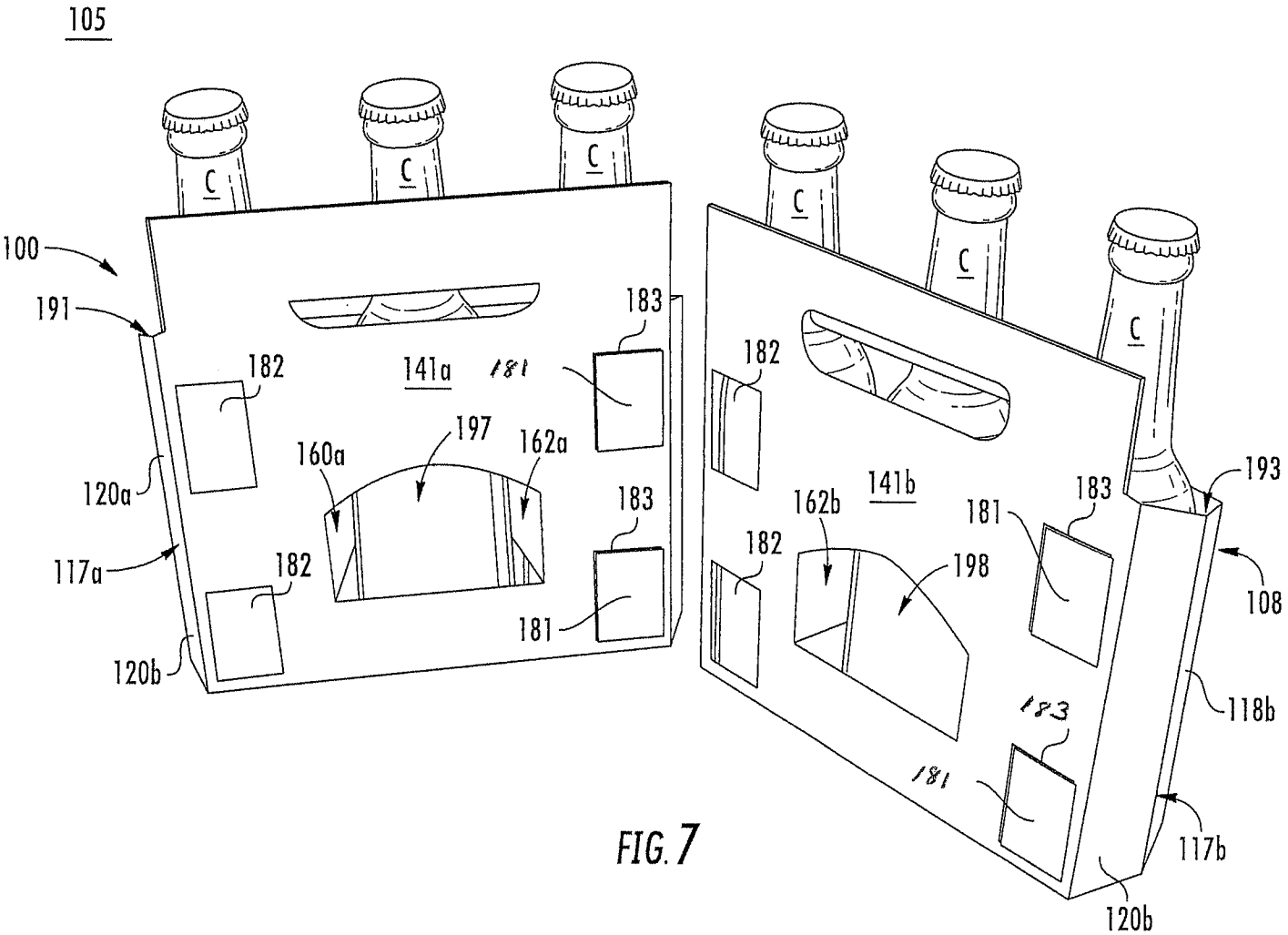
FIG. 7 is a perspective view of the carrier of FIG. 6 separated into a first portion and a second portion.

FIG. 1 is a plan view of an exterior side 101 of a blank 103 used to form a package or basket-style carrier 105 (FIG. 4), in accordance with a first exemplary embodiment of the present disclosure. As shown in FIGS. 4-7, the carrier 105 is sized to contain six containers C, three containers C being contained in a front portion 106 of the carrier 105 and three containers C being contained in a back portion 108 of the carrier 105. In a first configuration of the carrier 105 (FIG. 6), the front portion is attached to the back portion 108. In the illustrated embodiment, the containers C are beverage bottles, but the containers C could be any other suitable type and size of container without departing from the disclosure. The carrier 105 may be sized and shaped to hold more or less than six containers C. As will be discussed in greater detail below, the front portion 106 of the carrier 105 and the back portion 108 of the carrier 105 are separable along a line of weakening 110 that extends across the carrier 105 to allow the front portion 106 to be fully or partially separated from the back portion 108 in a second configuration of the carrier 105 (FIG. 7). In one embodiment, the separated front portion 106 and the separated back portion 108 each have three containers C, and the separated portions 106, 108 can be placed independently in a refrigerator or other location. In other embodiments, the front portion 106 and the back portion 108 of the carrier 105 can remain foldably attached in the second configuration after partial separation. Also, the carrier 105 can hold more or less than six containers C, with each of the front portion 106 and the back portion 108 of the carrier 105 holding more or less than three containers C without departing from the disclosure.

As shown in FIG. 1, the blank 103 has a longitudinal axis L1 and a lateral axis L2. The blank 103 has a front portion 107 for forming the front portion 106 of the carrier 105, and a back portion 109 for forming the back portion 108 of the carrier 105. In one embodiment, the front portion 107 and the back portion 109 are separated by the longitudinal centerline CL of the blank 103, as shown. As discussed in more detail below, the blank 103 is formed into the carrier 105 by folding the blank 103 about the centerline CL so that the front portion 107 and the back portion 109 are overlapped.

In the illustrated embodiment, the front portion 107 of the blank 103 comprises a front panel 115*a* foldably connected to a first side panel 117*a* and a second side panel 119*a*. The front portion 107 includes a front handle reinforcement flap 121*a* separated from the second side panel 119*a* and the front panel 115*a* by a cut 123*a*. The front handle reinforcement flap 121*a* includes an opening 130*a* and a handle flap 125*a* foldably connected to the front handle reinforcement flap 121*a* at a fold line 126*a* and adjacent to the opening 130*a*. An adhesive flap 127*a* is foldably connected to the first side panel 117*a* at a lateral fold line 129*a*. Lateral fold lines 131*a*, 133*a*, foldably connect a respective first and second side panel 117*a*, 119*a* to the front panel 115*a* and the first and second side panels 117*a*, 119*a* include respective lateral fold lines 132*a*, 134*a* dividing the side panels 117*a*, 119*a* into respective first and second portions 118*a*, 122*a* and 120*a*, 124*a*. The front portion 107 includes a first bottom panel 138*a* foldably connected to the front panel 115*a* at a longitudinal fold line 135*a*. In one embodiment, the first bottom panel 138*a* includes female locking features 139*a*, which may be configured as openings, as shown. As shown in FIG. 1, the front panel 115*a* includes two divider flaps 140*a*, 142*a* foldably connected to the front panel 115*a* at respective lateral fold lines 144*a*, 146*a*. Free edges of each divider flap 140*a*, 142*a* include an adhesive flap 148*a*, 150*a* foldably connected to the respective divider flaps 140*a*, 142*a* at respective lines of weakening 184*a*, 186*a*, as shown. The front panel 115*a* could be otherwise shaped, arranged, and/or configured, and could have other features, without departing from the disclosure.

In one embodiment, and as shown, the front portion 107 includes a front or first central panel 141*a* foldably connected to the second side panel 119*a* at a lateral fold line 143*a*. The first central panel 141*a* includes a handle portion 145*a* with handle features including a handle opening 147*a* and handle flap 151*a* foldably connected to the central panel 141*a* at a longitudinal fold line 153*a* and adjacent to the handle opening 147*a*. The blank 103 includes a second bottom panel 155*a* foldably connected to the central panel 141*a* along a longitudinal fold line 157*a*. The second bottom panel 155*a* includes male locking features 159*a*, which may be configured as tabs, as shown. As shown in FIG. 1, the central panel 141*a* includes two divider flaps 160*a*, 162*a* foldably connected to the central panel 141*a* at respective lateral fold lines 164*a*, 166*a*. Free edges of each divider flap 160*a*, 162*a* include an adhesive flap 168*a*, 170*a* foldably connected to the respective divider flaps 160*a*, 162*a* at respective lines of weakening 163*a*, 165*a*. The central panel 141*a* could be otherwise shaped, arranged, and/or configured, and could have other features, without departing from the disclosure. For example, the first bottom panel 138*a* could be foldably connected to the central panel 141*a* and the second bottom panel 155*a* could be foldably connected to the front panel 115*a* without departing from the disclosure.

In the illustrated embodiment, the features of the back portion 109 of the blank 103 include a back panel 115*b*, a first side panel 117*b*, a second side panel 119*b*, a central adhesive flap 127*b*, and a central panel 141*a* that are generally a mirror-image of the corresponding panels or flaps of the front portion 107. Corresponding components (e.g., panels, flaps, fold lines, cuts, etc.) have been designated by corresponding reference numbers that differ by the "a" or "b" suffix, with the "a" components corresponding to the front portion 107 and the "b" components corresponding to the back portion 109 of the blank 103. As shown in FIG. 1 and in contrast to the front portion 107, the back portion 109 of the blank 103 includes the first bottom panel 138*b* having female locking features 139*b* and being foldably connected to the central panel 141*b*, and the second bottom panel 155*b* having male locking features 159*b* and being foldably connected to the back panel 115*b*. In one embodiment, and as shown, the blank 103 includes a tear line 171 between the adhesive flaps 127*a*, 127*b* of the front portion 107 and the back portion 109, a tear line 173 between the handle reinforcement flaps 121*a*, 121*b* of the front portion 107 and the back portion 109, and a tear line 175 between the central panels 141*a*, 141*b* of the front portion 107 and the back portion 109. As noted below, when the carrier 105 is formed, the tear lines 171, 173, 175 combine, e.g., at least partially overlap, to form the line of weakening 110 (FIG. 4) in the carrier 105 for separating the front portion 106 and the back portion 108 of the carrier 105. One or more of the tear lines 171, 173, 175 could be other lines of weakening (e.g., fold lines, cut lines, etc.) without departing from the disclosure.

As shown, the blank 103 can include one or more removable connection patches or portions 181 in the central panels 141*a*, 141*b* and the adhesive flaps 127*a*, 127*b*. The removable connection patches 181 can be defined by a line of weakening 183 such as a tear line. As shown, one or more of the removable patches 181 can be coated with an adhesive G, such as a glue, to facilitate assembly and separation operations of the front portion 106 and the back portion 108 of the carrier 105. In embodiments, the removable patches 181 of the front portion 107 of the blank 103 may be coated with adhesive G, while the removable patches 181 of the back portion 109 of the blank 103 may be devoid of adhesive G. In other embodiments, removable patches 181 of the blank may be provided with adhesive G in a different pattern, e.g., an alternating or complementary pattern. The removable patches 181 can be otherwise shaped, arranged, configured, located, and/or omitted without departing from the disclosure.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 2:
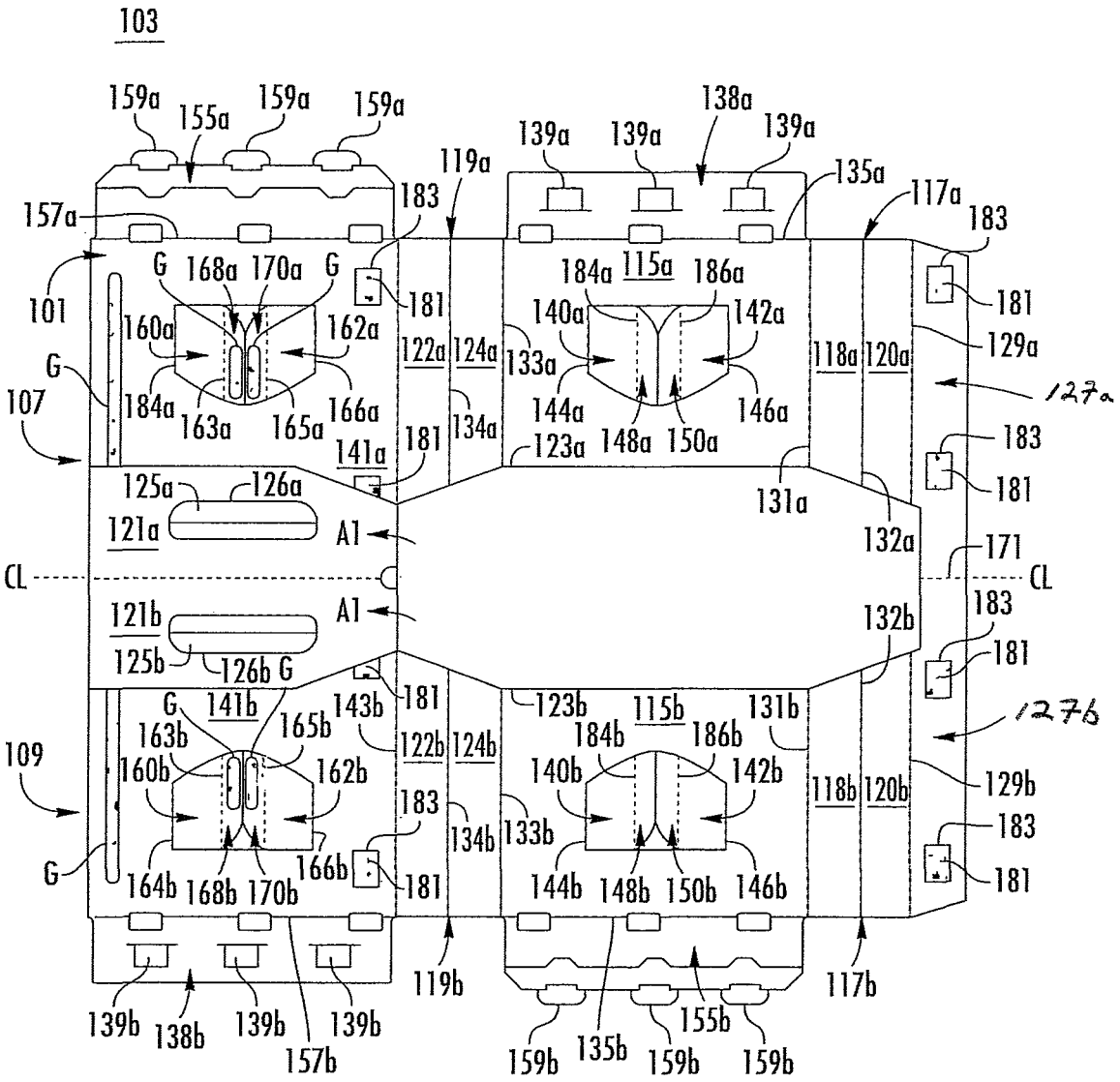
FIG. 2 is a plan view of an interior surface of the blank of FIG. 1 in a partially folded configuration.

Still referring to FIG. 1, and referring additionally to FIG. 2, in one exemplary method of erection, the blank 103 is positioned with its exterior surface 101 facing down and with an interior surface 102 of the blank 103 facing up, and the carrier 105 may be erected from the blank 103 by respectively folding the handle reinforcement flaps 121*a*, 121*b* in the direction of A1 along fold lines 143*a*, 143*b* so that the handle reinforcement flaps 121*a*, 121*b* overlap the central panels 141*a*, 141*b* on the interior surface 102 of the blank 103 such that the handle flaps 125*a*, 151*a* of the front portion 107 are overlapped and the handle flaps 125*b*, 151*b* of the back portion 109 are overlapped. As shown, adhesive G can be selectively applied to portions of the blank 103, e.g., along portions of the central panels 141*a*, 141*b* and the reinforcement panels 121*a*, 121*b*, and the adhesive flaps 148*a*, 150*a*, 168*a*, 170*a*, 148*b*, 150*b*, 168*b*, and 170*b*, as shown, to facilitate erection of the blank 103. In embodiments, adhesive G may be applied in a different pattern along the blank 103.

Figure 3:
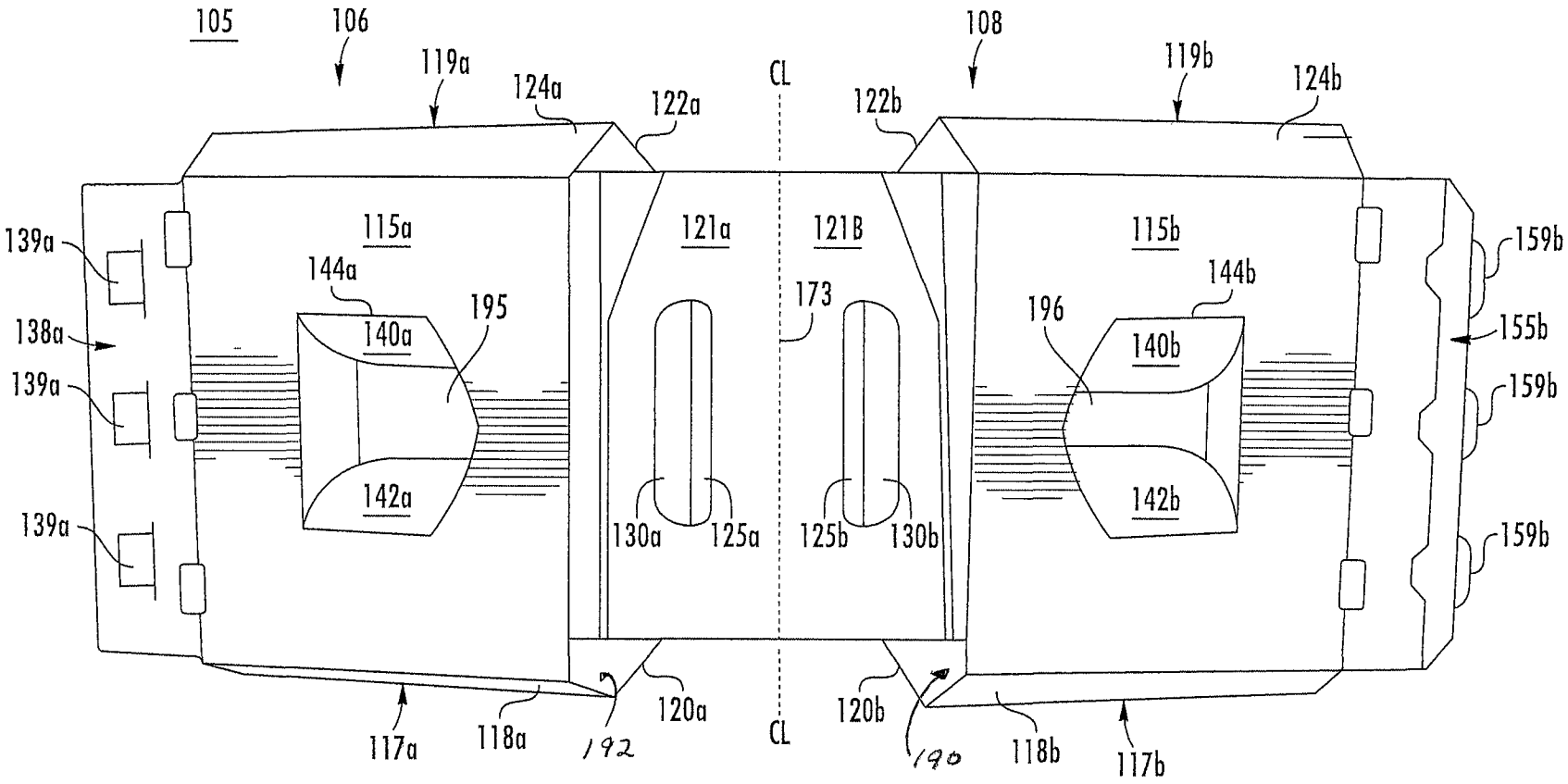
FIG. 3 is a perspective view of the blank of FIG. 1 in a partially folded configuration.

Referring additionally to FIG. 3, the front panel 115*a* and back panel 115*b* are folded about fold lines 134*a*, 134*b* to be brought into face-to-face contact with the respective central panels 141*a*, 141*b*. The adhesive flaps 127*a*, 127*b* are brought into face-to-face contact with the marginal portion of the respective central panels 141*a*, 141*b* and adhesively attached thereto by adhesive G such that a front interior space 190 and a back interior space 192 of the carrier 105 is defined. In such a configuration, the divider flaps 140*a*, 162*a* can be folded about respective fold lines 144*a*, 166*a* toward one another and connected by the engagement and adhesive attachment of the respective adhesive flaps 148*a*, 170*a*, and the divider flaps 142*a*, 160*a* can be folded about respective fold lines 146*a*, 164*a* toward one another and connected by the engagement and adhesive attachment of the adhesive flaps 150*a*, 168*a*. Similarly, the divider flaps 140*b*, 162*b* can be folded about respective fold lines 144*b*, 166*b* toward one another and connected by the engagement and adhesive attachment of the respective adhesive flaps 148*b*, 170*b*, and the divider flaps 142*b*, 160*b* can be folded about respective fold lines 146*b*, 164*b* toward one another and connected by the engagement and adhesive attachment of the adhesive flaps 150*b*, 168*b*. Such assembly results in a partially-formed configuration of the carrier 105 having the front portion 106 and back portion 108, as shown. The adhered divider flaps 142*a*, 160*a* and 140*a*, 162*a* form an opening or window 195 in the front panel 115*a* and an opening or window 197 (FIG. 7) in the central panel 142*a* such that the one or more containers C disposed in the carrier 105 are visible and/or can be accessed. The respective adhered divider flaps 142*b*, 160*b* and 140*b*, 162*b* form an opening or window 196 in the back panel 115*b* and an opening or window 198 (FIG. 7) in the central panel 142*b*.

Figure 4:
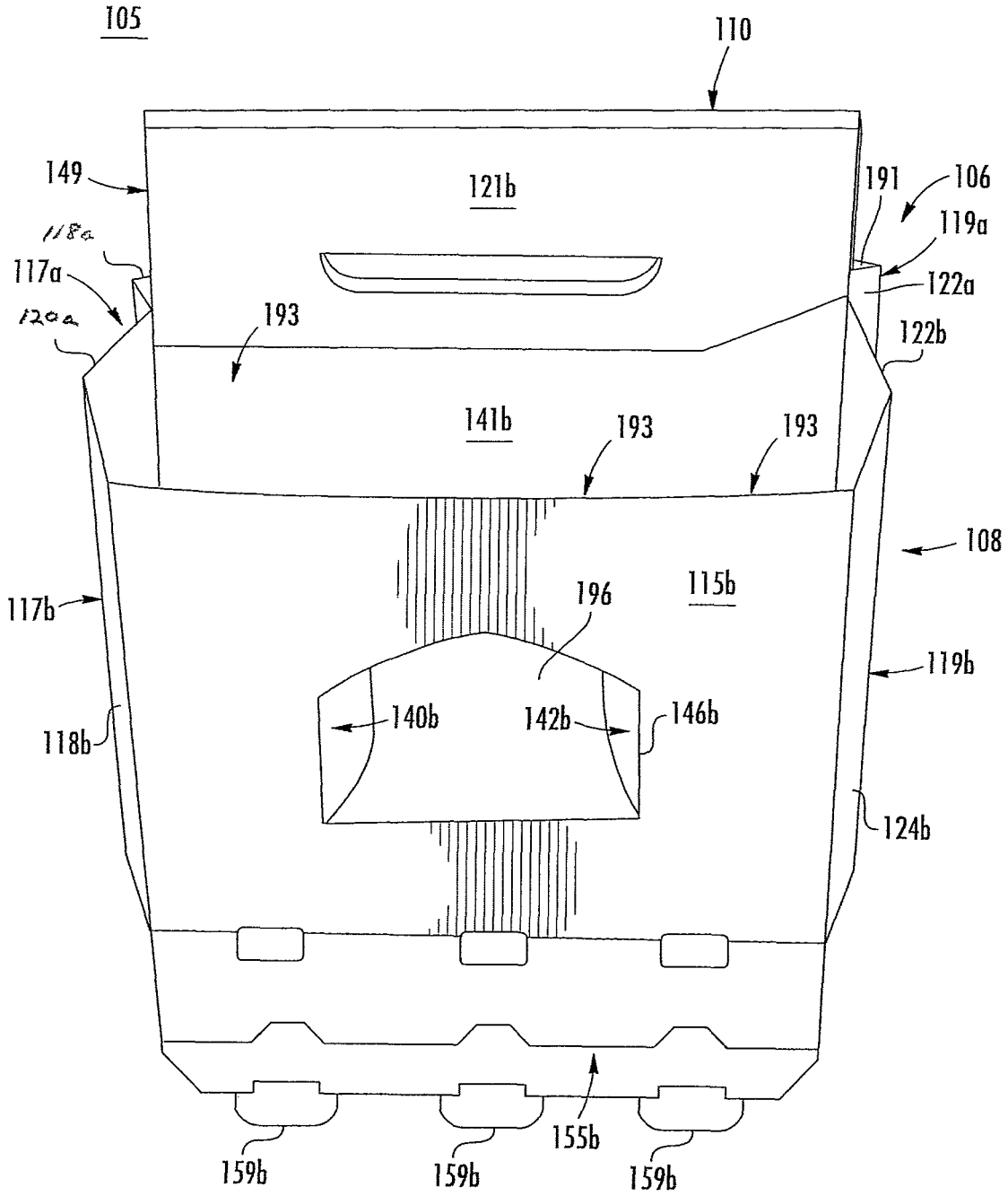
FIG. 4 is a perspective view of a carrier formed from the blank of FIG. 1 in an open configuration.

Still referring to FIG. 1, and referring additionally to FIG. 4, the front portion 106 and back portion 108 of the partially-formed carrier 105 having respective open bottoms is folded about the overlapped tear lines 171, 173, 175 along the central longitudinal axis CL so that the central panels 141*a*, 141*b* are brought into face-to-face contact and can be adhesively attached at the connection patches 181. The carrier 105 can be further opened by positioning the first and second side panels 117*a*, 117*b* and 119*a*, 119*b* in substantially perpendicular relation to the front and back panels 115*a*, 115*b* and the central panels 141*a*, 141*b*, and with the central panels 141*a*, 141*b* and the front and back panels 115*a*, 115*b* in parallel relationship with one another. A handle 149, as shown, extends upwardly along a central portion of the carrier 105. As shown, the adhered divider flaps 142*a*, 160*a* and 140*a*, 162*a* extend between the central panel 141*a* and the front panel 115*a* to form three container-receiving spaces 191 in the front interior space 190 (FIG. 3) in the front portion 106. Similarly, the adhered divider flaps

142*b*, 160*b* and 140*b*, 162*b* extend between the central panel 141*b* and the back panel 115*b* to form three container-receiving spaces 193 in the back interior space 192 (FIG. 3) in the back portion 108. Thus, as illustrated, the carrier 105 is provided having an open configuration with bottom panels 138*a*, 155*a* and 138*b*, 155*b* disengaged from one another.

Figure 5:
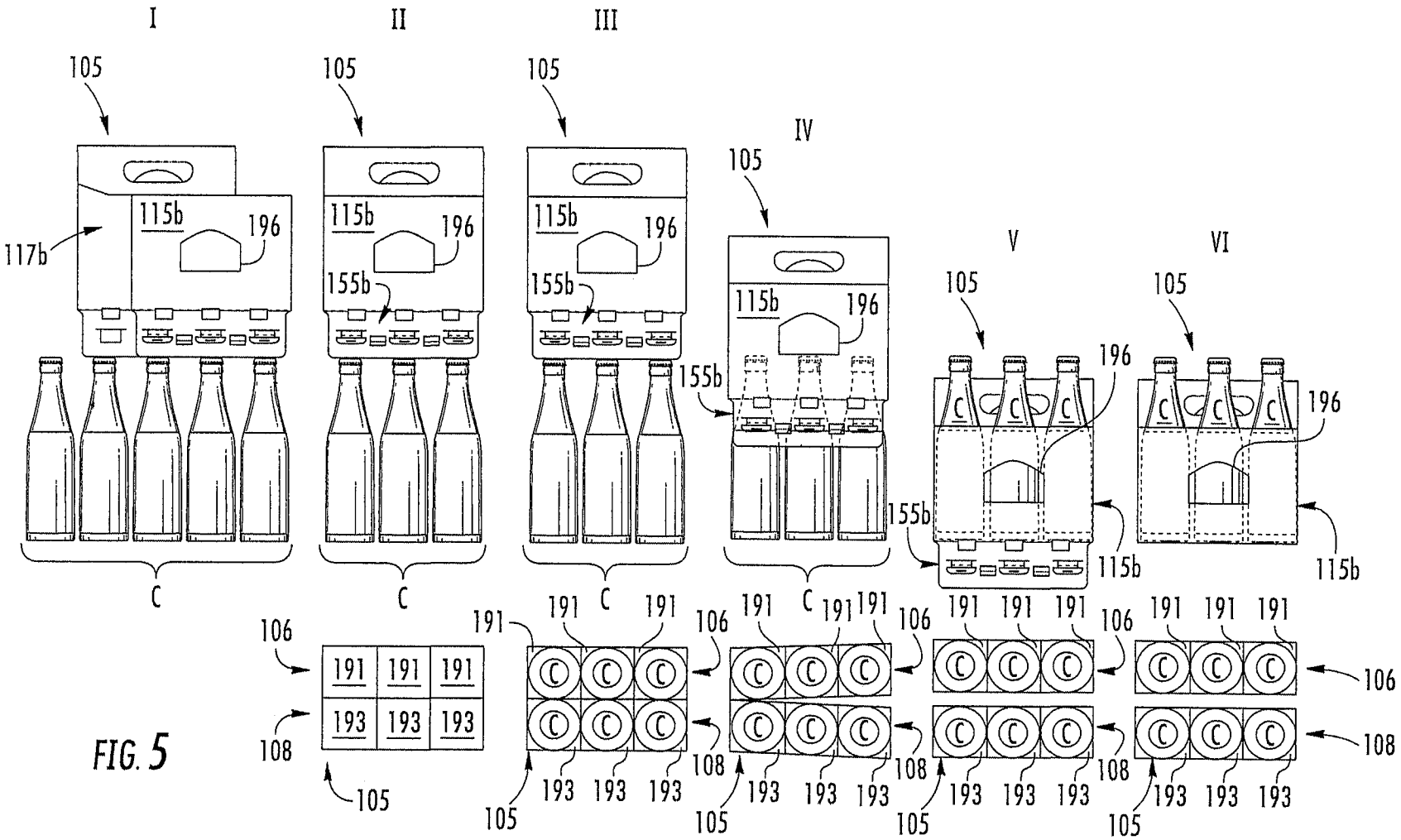
FIG. 5 is a schematic view of a container-loading operation of the carrier of FIG. 4.
Figure 6:
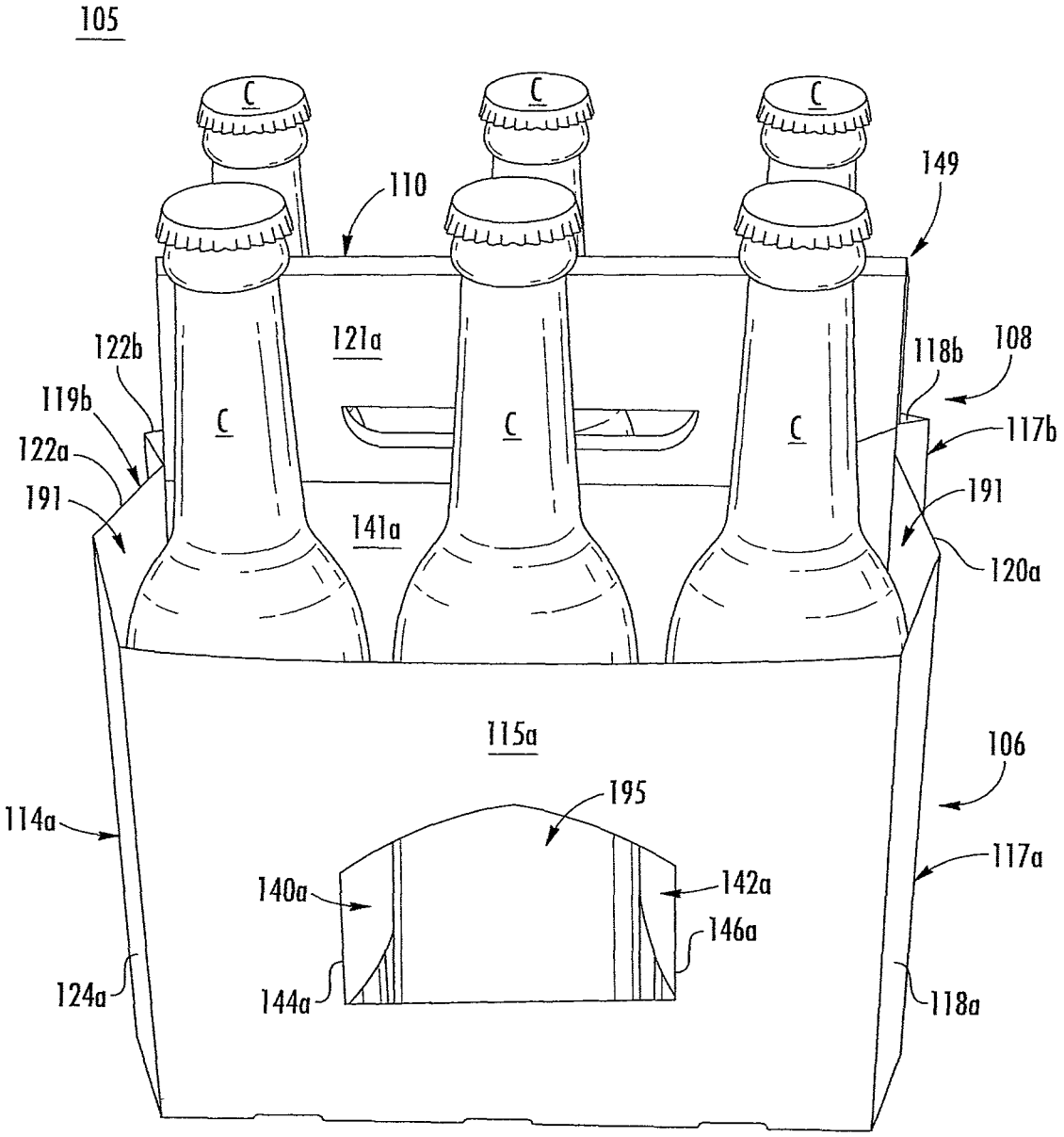
FIG. 6 is a perspective view of the carrier of FIG. 4 in a closed configuration and including containers.

Referring additionally to FIG. 5, in one embodiment, the opened front portion 106 and opened back portion 108 can be lowered onto groups of containers C so that three containers C are received in the front portion 106 and three containers C are received in the back portion 108. Such a loading operation can be accomplished, for example, with one or more carriers 105 being moved along an overhead carrier assembly (not shown) in concert with groups of containers C being carried along a conveyor or belt (not shown). At the upstream end of the loading operation, in a loading stage I, the carrier 105 having the open bottom panels 138*a*, 155*a* and 138*b*, 155*b* is fed to the forming area, as illustrated. In stage II of the loading operation, the carrier 105 is progressed through a folding/positioning apparatus (not shown) and opened as described above. In stage III of the loading operation, as shown, the open-bottomed carrier 105 is positioned over a 3×3 group of containers C. In stage IV of the loading operation, as shown, the carrier 105 is lowered onto the group of containers C such that the containers C are received in the container-receiving spaces 191, 193 of the carrier 105. As shown, in stage V and stage VI of the loading operation, the bottom panels 138*a*, 155*a* are overlapped to close the bottom of the front portion 106 of the carrier 105 and the bottom panels 138*b* and 155*b* are overlapped to close the bottom of the back portion 108 of the carrier 105 so that the containers C are contained in the carrier 105. Such engagement may be accomplished for example, with the male locking features 159*a*, 159*b* interlocked with a respective female locking feature 139*a*, 139*b* to interlock the bottom panels 138*a*, 155*a* and 138*b*, 155*b*. The bottom panels 138*a*, 155*a* and 138*b*, 155*b* can be interlocked or secured by other means (e.g., adhesive or locking features that are otherwise shaped) without departing from the disclosure.

Referring to FIGS. 1 and 7, the front portion 106 and the back portion 108 of the carrier 105 can be torn along the tear line 110, e.g., such that tear lines 171, 173, 175 are collectively torn, so that the front portion 106 and the back portion 108 of the carrier 105 are separated from one another, as shown. When the front portion 106 and back portion 108 are separated, the portion of the connection patches 181 of one of the central panels 141*a*, 141*b* and the adhesive flaps 127*a*, 127*b* can separated and adhesively attached to the other of the central panels 141*a*, 141*b* and the adhesive flaps 127*a*, 127*b*. Such separation of the removable patches 181 from one or the other of the front portion 106 and the back portion 108 of the carrier 105 may be determined, for example, by the relative strength of the connection of a given removable patch 181 provided by a respective line of weakening 183. In one embodiment, the separation of the removable patch 181 from one panel 141*a*, 141*b* or flap 127*a*, 127*b* and the adhesive attachment of the removable patch 181 to the opposite panel 141*a*, 141*b* or flap 127*a*, 127*b* can cause an opening 182 in one or more of the panels 141*a*, 141*b* or flaps 127*a*, 127*b* corresponding to the shape of the line of weakening 183 that forms the removable patch 181. In other embodiments, the removable patches 181 may only partially separate from a respective panel 141*a*, 141*b* or flap 127*a*, 127*b* upon separation of the front portion 106 and the back portion 108 of the carrier 105. The removable patches 181 could be otherwise shaped, arranged, configured, and/or activated without departing from the disclosure.

In this regard, the blank 103 can be provided and assembled as described herein to provide a carrier 105 having a front portion 106 and a back portion 108 that are separable from one another to provide at least two individual portions that contain at least one container C. Such separate portions of the carrier 105 can be transported, stored, or otherwise used separately from one another or in cooperation.

Figure 8:
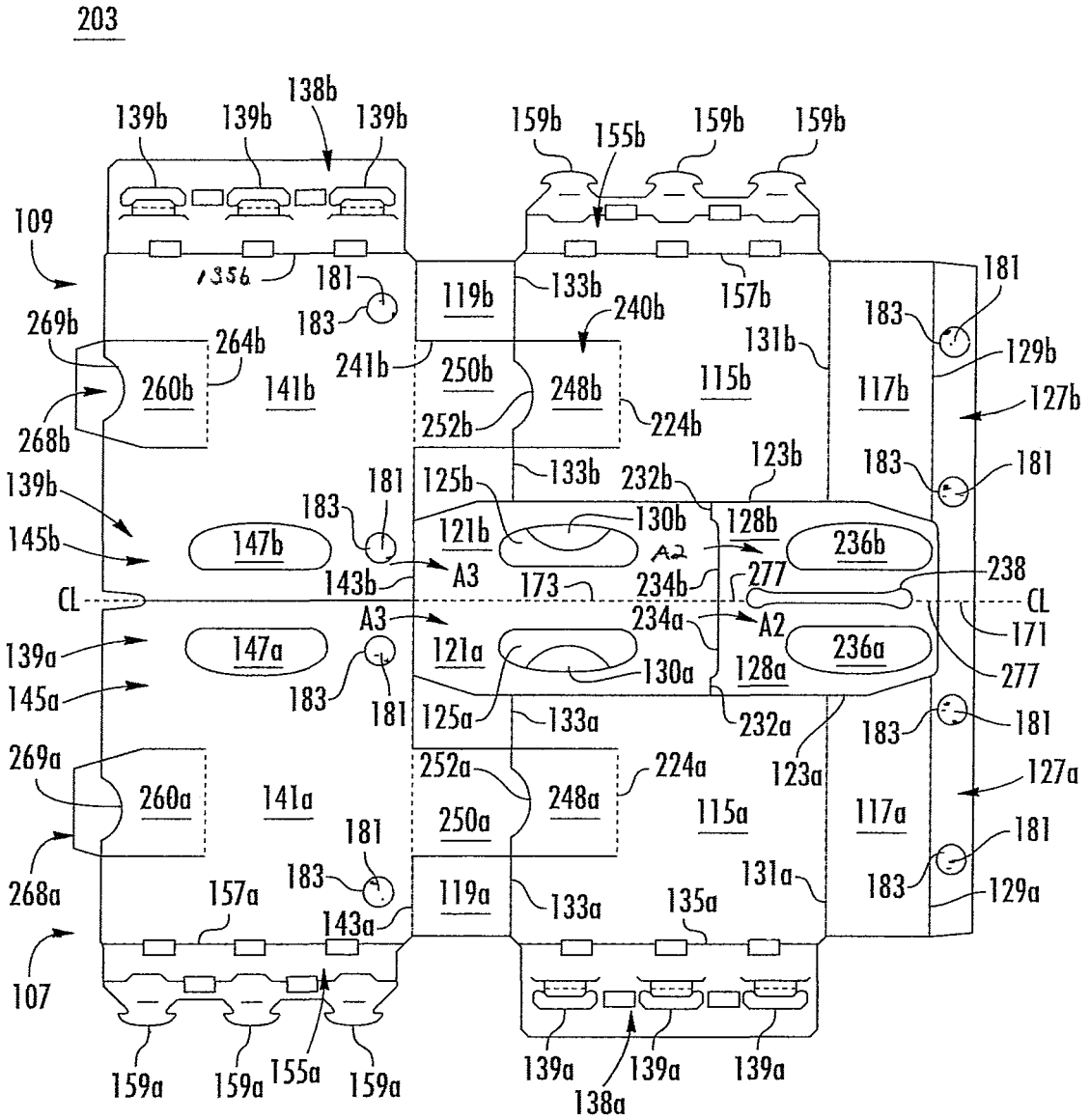
FIG. 8 is a plan view of an outer surface of a blank for forming a carrier according to a second exemplary embodiment of the disclosure.

FIGS. 8-12 illustrate a second exemplary embodiment of the disclosure similar to the first embodiment, and like or similar reference numbers are indicated throughout the drawings to indicate like or similar features. FIG. 8 illustrates a blank 203 for forming the carrier 205 of the second embodiment. As with the first embodiment, the blank 203 includes a front portion 107 for forming the front portion 106 of the carrier 205 and a back portion 109 for forming the back portion 108 of the carrier 205. As shown in FIG. 8, the blank 203 includes a second handle reinforcement flap 128*a*, 128*b* foldably connected to a respective handle reinforcement flap 121*a*, 121*b* at a line of weakening 230 that can include lateral fold lines 232*a*, 232*b* and cuts 234*a*, 234*b* extending between the lateral fold lines 232*a*, 232*b*. The second handle reinforcement flaps 128*a*, 128*b* include respective openings 236*a*, 236*b* and are separated by a central opening 238 extending along the centerline CL of the blank 203 and a pair of tear lines 277 that form a portion of a line of weakening 210 that includes tear lines 171, 173, 175 and 277, as shown. In the second embodiment, the blank 203 includes a divider flap 240*a* foldably connected to the front panel 115*a* at a fold line 244*a* and foldably connected to the central panel 141*a* at a portion of the fold line 143*a*. As shown, the divider flap 240 is separated from the front panel 115*a* and the second side panel 119*a* by laterally-extending cuts 241*a*, 243*a*. The divider flap 240 includes a first portion 248*a* foldably connected to the front panel 115*a* at the fold line 244*a* and a second portion 250*a* foldably connected to the central panel 141*a* at the portion of the fold line 143*a*. In one embodiment, the first portion 248*a* and the second portion 250*a* are separated by a line of weakening 252*a* that includes a cut extending from portions of the fold line 133*a*. The central panel 141*a* includes a divider flap 260*a* foldably connected to the central panel 141*a* at a lateral fold line 264*a* and having a free edge including an adhesive flap 268*a* foldably connected to the divider flap 260*a* at a line of weakening 269*a*. In the second embodiment, as illustrated, the divider flap 260*a* extends to the edge of the blank 203. The back portion 109 of the blank 203 includes divider flaps 240*b*, 260*b* and other features similar to the front portion 107.

Figure 9:
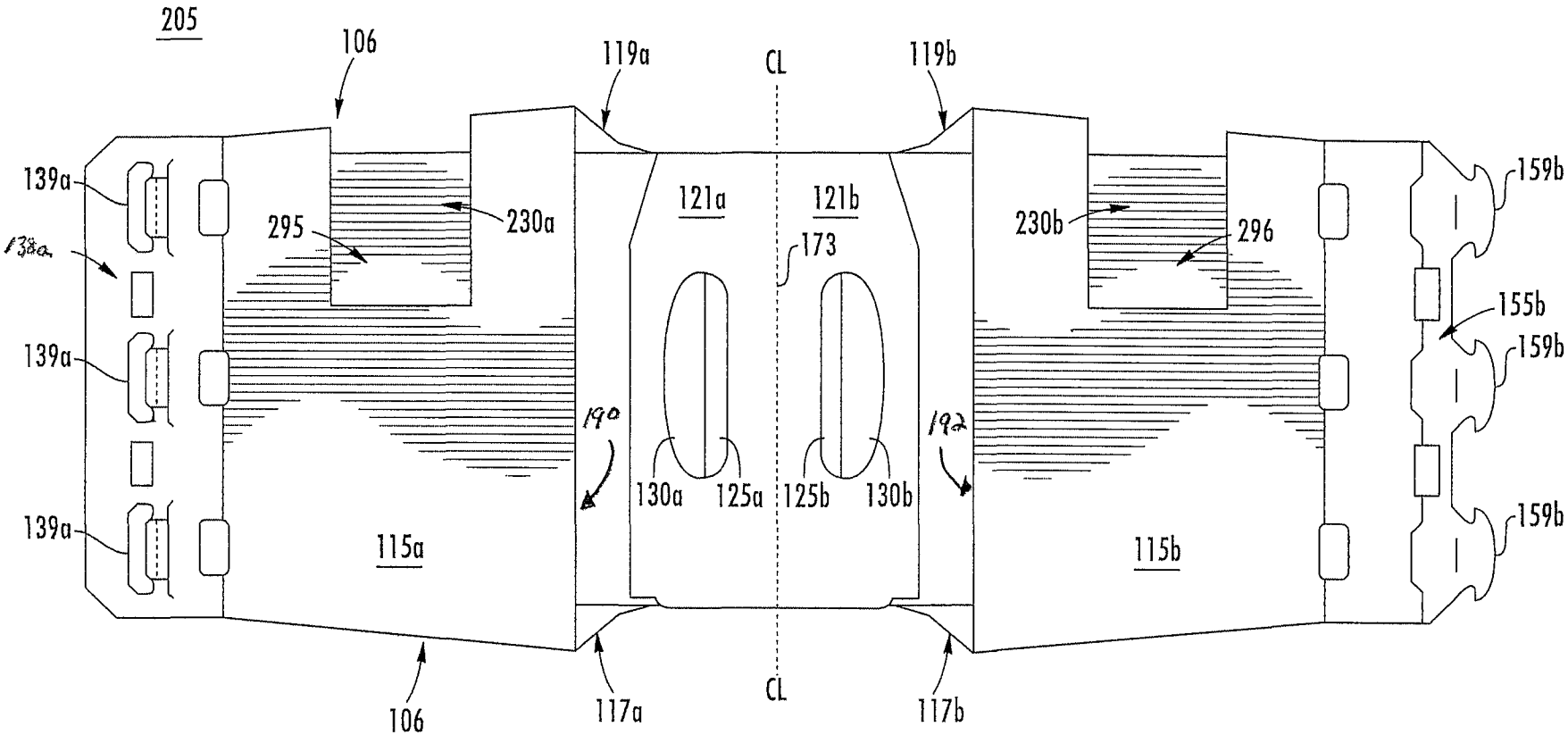
FIG. 9 is a perspective view of the blank of FIG. 8 in a partially folded configuration.
Figure 10:
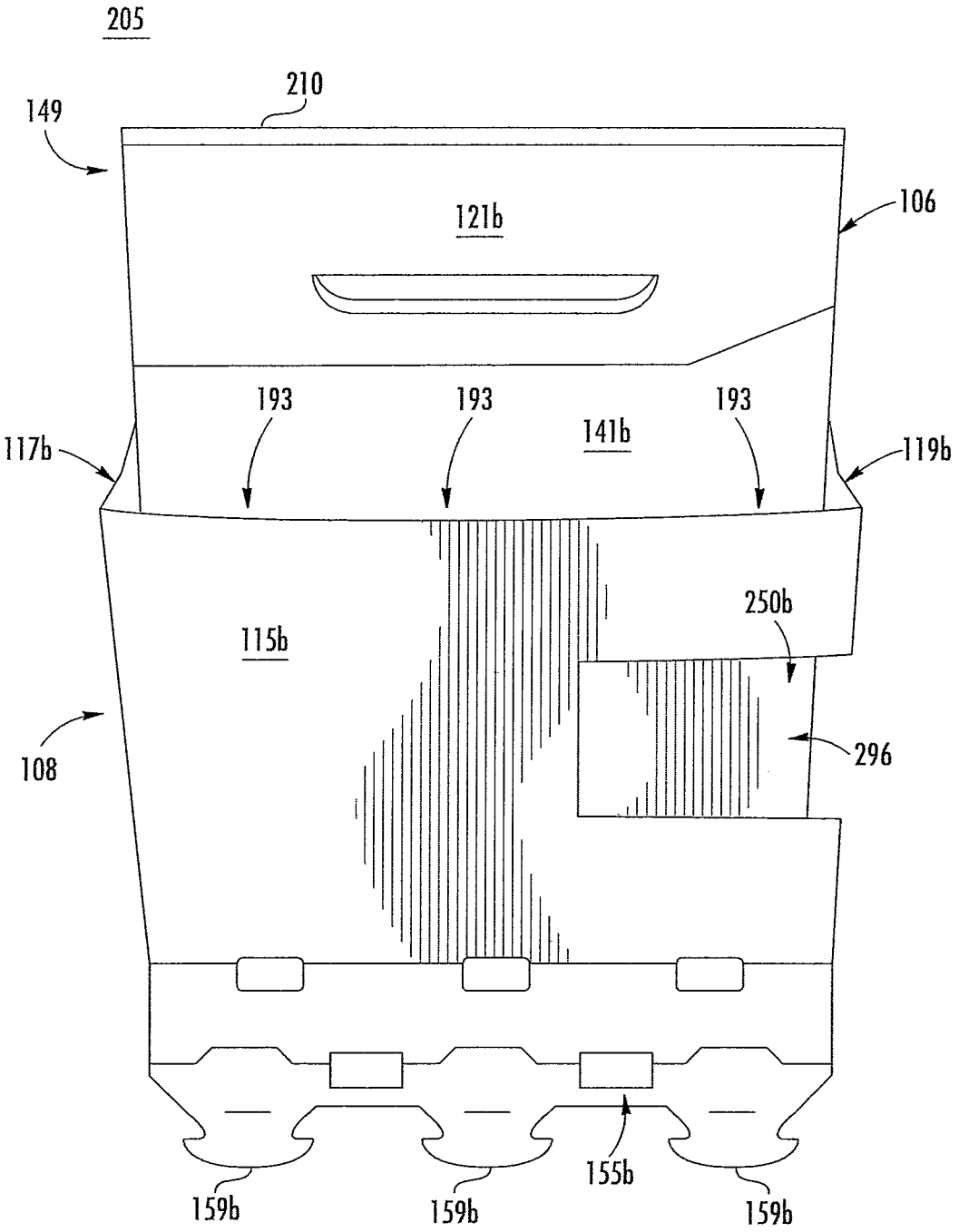
FIG. 10 is a perspective view of a carrier formed from the blank of FIG. 8 in an open configuration.

Still referring to FIG. 8, and referring additionally to FIGS. 9 and 10, the carrier 205 can be formed in a similar manner as the carrier 105 of the first embodiment. In particular, the second handle reinforcement flaps 128*a*, 128*b* can be folded along the line of weakening 230 in the direction of A2 along fold lines 232*a*, 232*b* so that the second handle reinforcement flaps 128*a*, 128*b* overlap the respective first handle reinforcement flaps 121*a*, 121*b*. The overlapped first and second handle reinforcement flaps 121*a*, 121*b* and 128*a*, 128*b* can be folded in the direction of A3 along fold lines 143*a*, 143*b* so that the handle reinforcement flaps 121*a*, 128*a* and 121*b*, 128*b* overlap the respective central panels 141*a*, 141*b*. The front panel 115*a* and back panel 115*b* can be folded about fold lines 143*a*, 143*b* to be brought into face-to-face contact with the respective central panels 141*a*, 141*b*. The adhesive flaps 127*a*, 127*b* are brought into face-to-face contact with the marginal portion of the respective central panels 141*a*, 141*b* and adhesively attached thereto, for example, by an adhesive. The front portion 106 and back portion 108 of the partially formed carrier 205 having respective open bottoms is folded about the overlapped tear lines 171, 173, 175, 277 along the central longitudinal axis CL so that the central panels 141*a*, 141*b* are brought into face-to-face contact and can be adhesively attached to provide the open-bottomed carrier 205 shown in FIG. 10.

The divider flaps 240*a*, 240*b* may be positioned such that the respective first portions 248*a*, 248*b* and second portions 250*a*, 250*b* are folded along the respective lines of weakening 252*a*, 252*b* and positioned inwardly along the carrier 205 so that the second portions 250*a*, 250*b* of the respective divider flaps 240*a*, 240*b* overlap the central panels 141*a*, 141*b* and the first portions 248*a*, 248*b* of the respective divider flaps 240*a*, 240*b* extend between the central panels 141*a*, 141*b* and the respective front panel 115*a* or back panel 115*b*. In this regard, the divider flaps 240*a*, 240*b* are disposed at right angles, e.g., in an L-shaped configuration, to define interior corners of the carrier 205 that provide a divider between two respective container-receiving spaces 191, 193 of the respective front interior space 190 and back interior space 192 of the carrier 205. The divider flaps 260*a*, 260*b* also extend between the central panels 141*a*, 141*b* and the respective front panel 115*a* and back panel 115*b* and can be adhesively attached to the respective front panel 115*a* and back panel 115*b* by the adhesive flaps 268*a*, 268*b*. In the second embodiment, as illustrated, the divider flaps 240*a*, 240*b* form a respective window 295, 296 in a corner of the respective front portion 106 and back portion 108 of the carrier 205. Similarly, the divider flaps 260*a*, 260*b* from a respective window 297, 298 in a portion, e.g., on respective panels 141*a*, 141*b*, of opposite corners of the respective front portion 106 and back portion 108 of the carrier 205. The windows 295, 296, 297, 298 allow portions of the containers C to be visible and/or at least partially accessed from the exterior of the carrier 205 and one or more of the windows 295, 296, 297, 298 could be otherwise shaped, arranged, position, configured, and/or omitted without departing from the disclosure.

Figure 11:
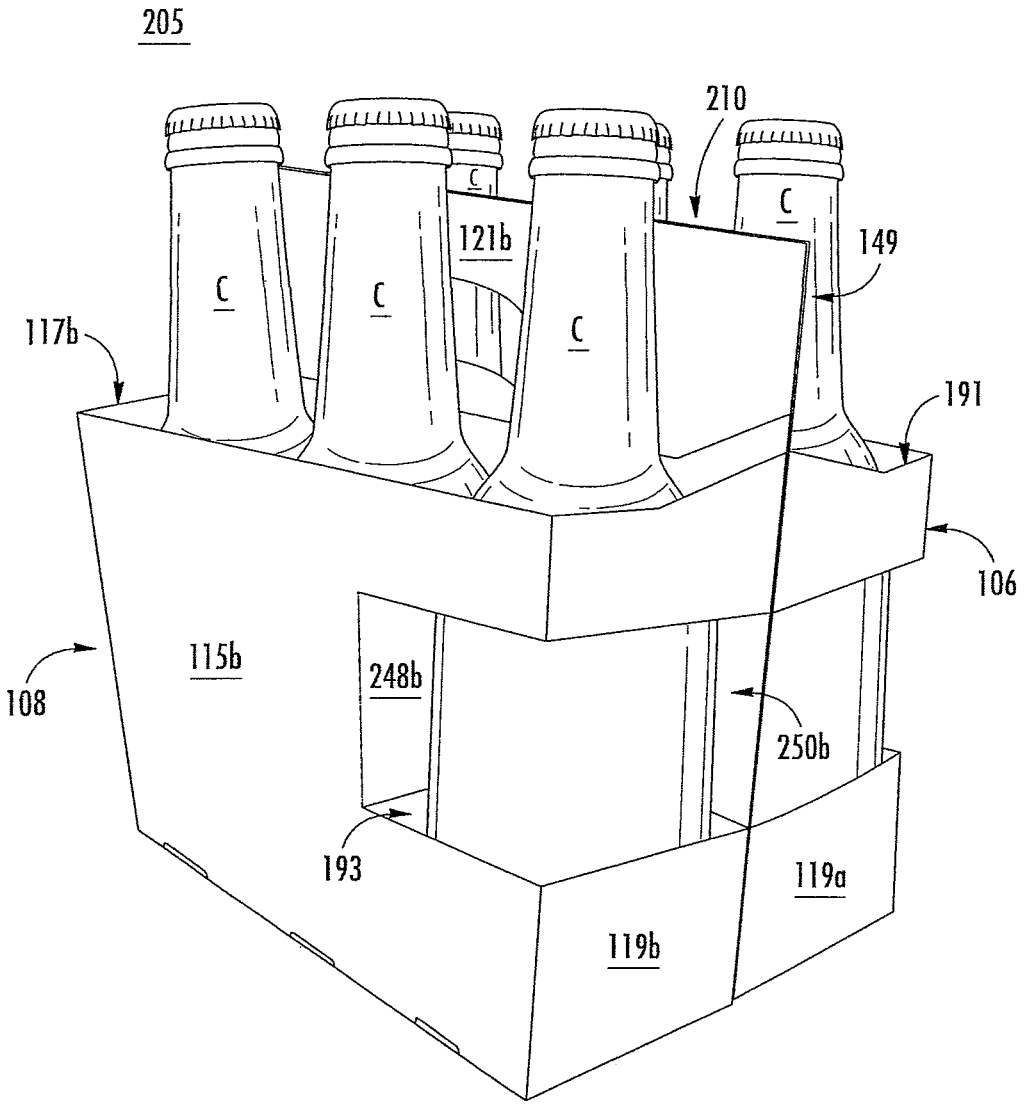
FIG. 11 is a perspective view of the carrier of FIG. 10 in a closed configuration and including containers.

Referring to FIGS. 8 and 11, the carrier 205 can be loaded with containers C and the bottom panels 138*a* and 155*a* can be overlapped to close the bottom of the front portion 106 of the carrier 205 and the bottom panels 138*b* and 155*b* can be overlapped to close the bottom of the back portion 108 of the carrier 205 so that the containers C are contained in the carrier 205. Such loading and closure of the carrier 205 can be accomplished in a similar manner to that described with regard to carrier 105 described above.

Figure 12:
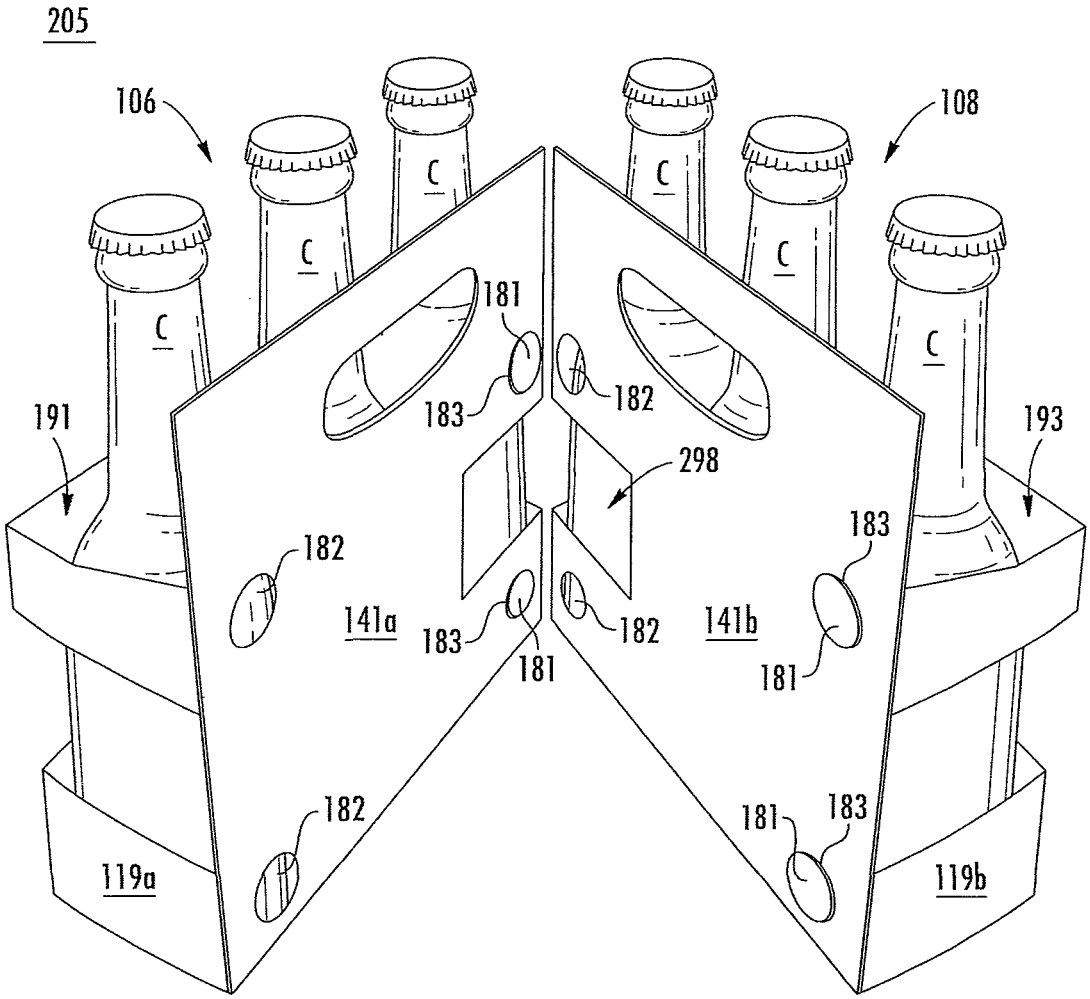
FIG. 12 is a perspective view of the carrier of FIG. 11 separated into a first portion and a second portion.

Referring additionally to FIG. 12, the front portion 106 and the back portion 108 of the carrier 205 can be torn along the tear line 210, e.g., such that tear lines 171, 173, 175, and 277 are collectively torn, such that the front portion 106 and the back portion 108 of the carrier 205 are separable from one another, as shown. Removable patches 181, as shown, may facilitate separation of the front portion 106 and the back portion 208 of the carrier 205 as described above with respect to carrier 105.

In this regard, blank 203 can be provided and assembled as described herein to provide a carrier 205 having a front portion 106 and a back portion 108 that are separable from one another to provide at least two individual portions 106, 108 that contain at least one container C. Such separate portions of the carrier 205 can be transported, stored, or otherwise used separately from one another or in cooperation. The portions 106, 108 of the carrier 205 incorporate additional windows, e.g., windows 295, 296, 297, 298, as compared to carrier 105 described above, which allows for different visibility and/or accessibility of containers C stored therein.

Figure 13:
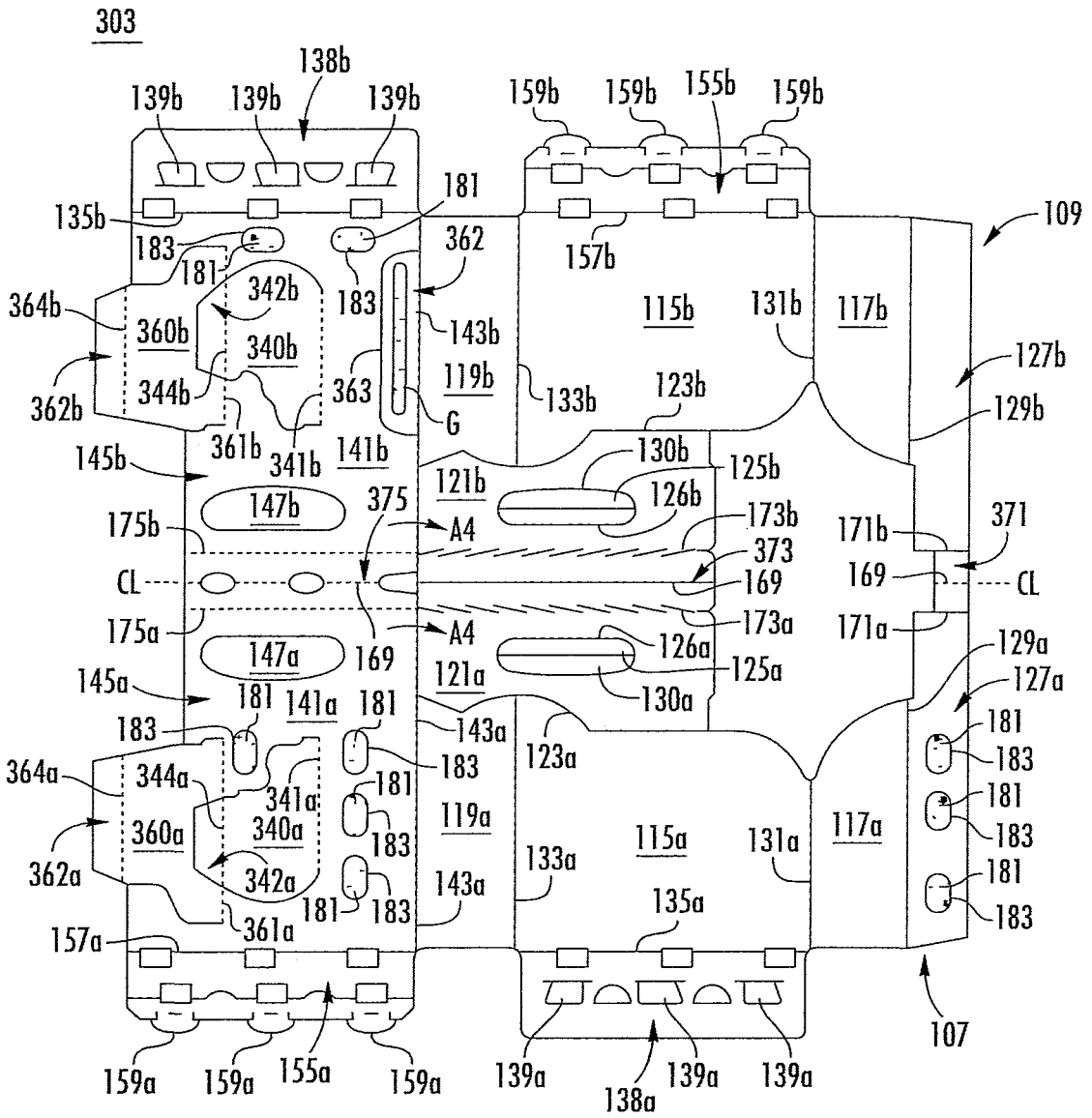
FIG. 13 is a plan view of an outer surface of a blank for forming a carrier according to a third exemplary embodiment of the disclosure.

FIGS. 13-17 illustrate a third exemplary embodiment of the disclosure similar to the first and second embodiments, and like or similar reference numbers are indicated throughout the drawings to indicate like or similar features. FIG. 13 illustrates a blank 303 for forming a carrier 305 of the third embodiment. As with the previous embodiments, the blank 303 includes a front portion 107 for forming the front portion 106 of the carrier 305 and a back portion 109 for forming the back portion 108 of the carrier 305. As shown in FIG. 13, the blank 303 includes two divider flaps 340*a*, 360*a* and 340*b*, 360*b* foldably connected to each respective central panel 141*a*, 141*b* along respective fold lines 341*a*, 361*a* and 341*b*, 361*b*. Each divider flap 340*a*, 360*a*, 340*b*, 360*b* has a free edge portion including a respective adhesive flap 342*a*, 362*a*, 342*b*, 362*b* foldably attached to the respective flaps 340*a*, 360*a*, 340*b*, 360*b* at respective fold lines 344*a*, 364*a*, 344*b*, 364*b*. In the third embodiment, as shown, the blank 303 includes tear strips 371, 373, 375 extending along the centerline CL across the respective adhesive flaps 127*a*, 127*b*, handle reinforcement flaps 121*a*, 121*b*, and central panels 141*a*, 141*b*. The tear strips 371, 373, 375 are formed by respective tear lines 171*a*, 173*a*, 175*a* in the front portion 107 of the blank 303 and respective tear lines 171*b*, 173*b*, 175*b* in the back portion 109 of the blank 303, and include a central fold line 169 extending along the centerline CL. As shown in FIG. 13, the central panel 141*b* of the back portion 109 of the blank 303 includes an attachment flap 362 defined by a tear line 363 extending on a portion of the central panel 141*b* and being foldably connected to the second side panel 119*b* at a portion of the fold line 143*b*. In embodiments, the attachment flap 362 may be disposed on the central panel 141*a* of the front portion of the blank 303, or an attachment flap 362 may be disposed on each of the central panels 141*a*, 141*b* of the blank 303.

Figure 14:
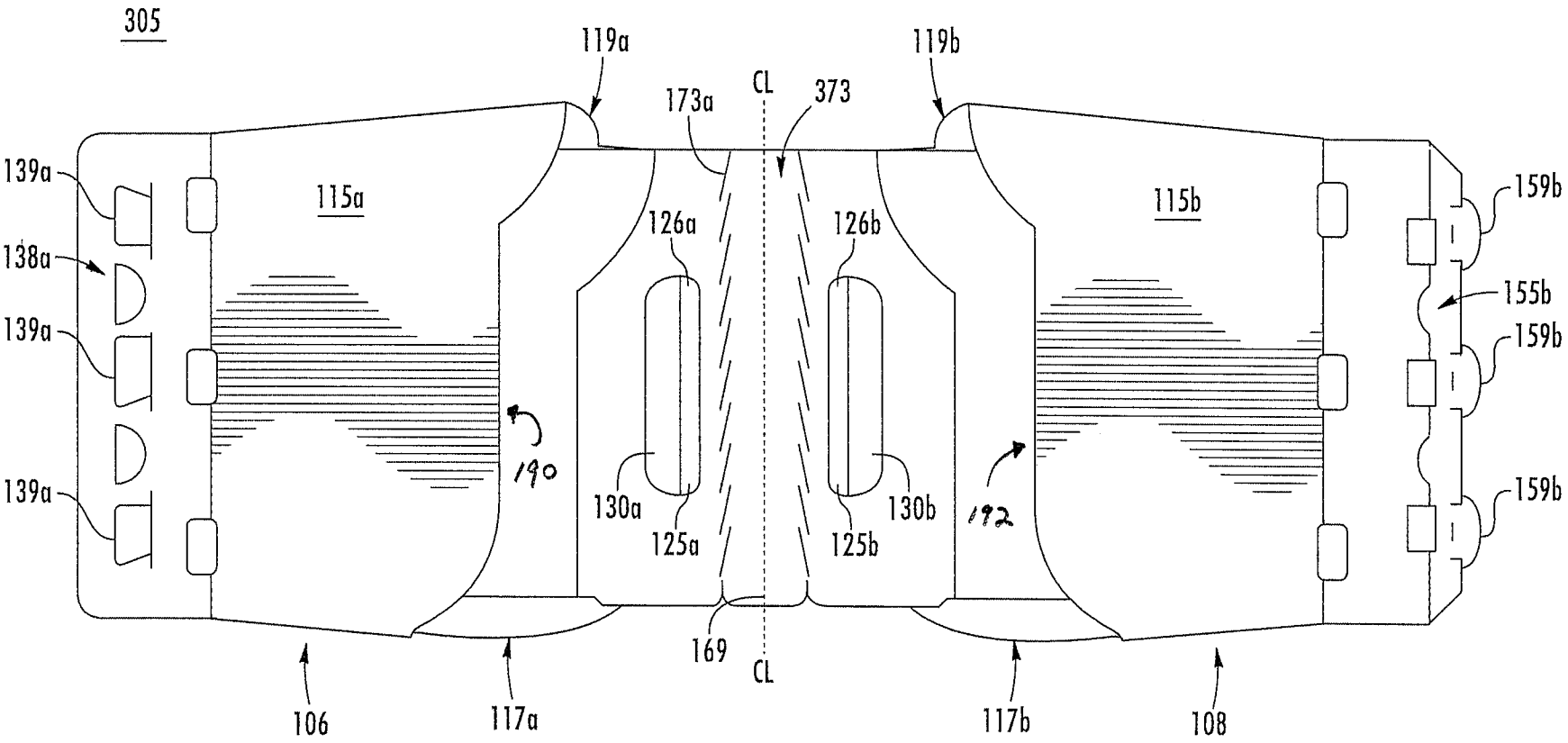
FIG. 14 is a perspective view of the blank of FIG. 13 in a partially folded configuration.
Figure 15:
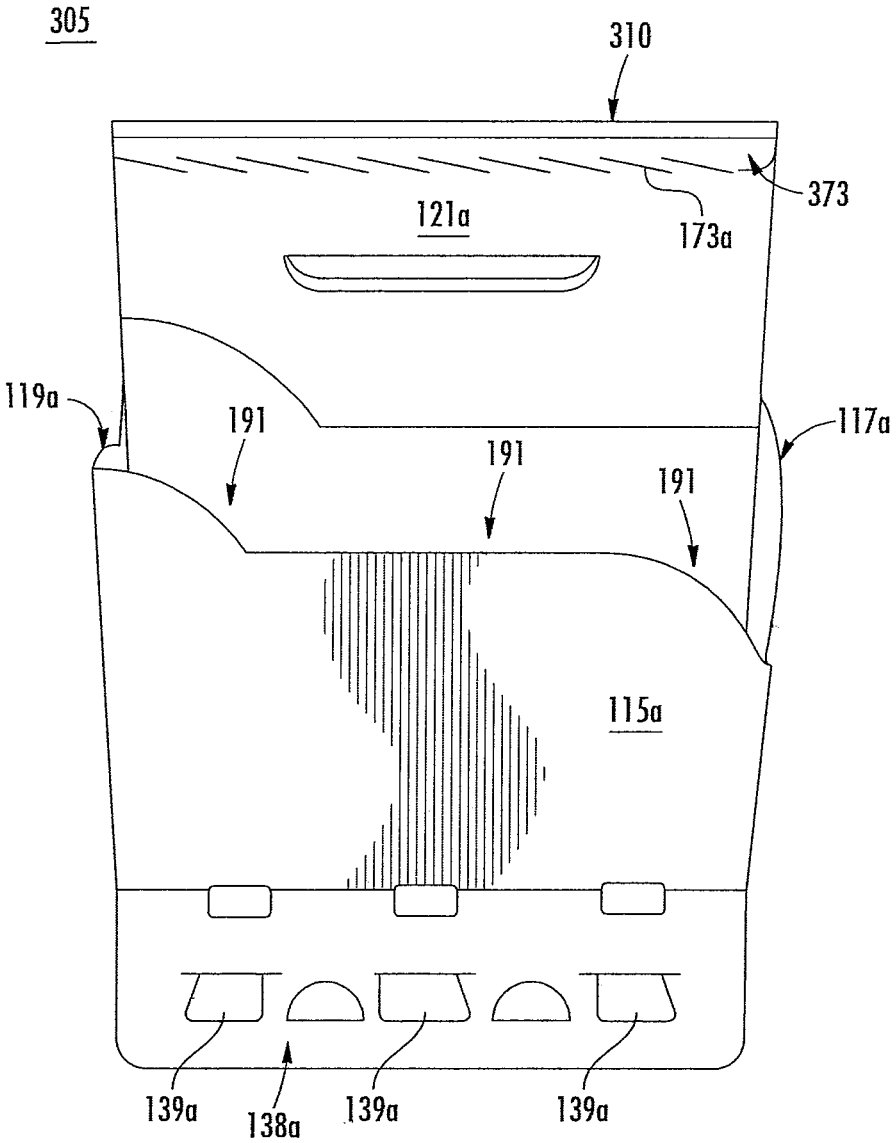
FIG. 15 is a perspective view of a carrier formed from the blank of FIG. 13 in an open configuration.

Still referring to FIG. 13, and referring additionally to FIGS. 14 and 15, the carrier 305 can be formed in a similar manner as the carrier 105 of the first embodiment and the carrier 205 of the second embodiment. In particular, the handle reinforcement flaps 121*a*, 121*b* can be folded along the fold lines 143*a*, 143*b* in the direction of A4 so that the handle reinforcement flaps 121*a*, 121*b* overlap the respective central panels 141*a*, 141*b*. The front panel 115*a* and back panel 115*b* can be folded about fold lines 143*a*, 143*b* to be brought into face-to-face contact with the respective central panels 141*a*, 141*b*. The adhesive flaps 127*a*, 127*b* are brought into face-to-face contact with the marginal portion of the respective central panels 141*a*, 141*b* and adhesively attached thereto, for example, by an adhesive. The front portion 106 and back portion 108 of the partially formed carrier 305 having respective open bottoms is folded about the central fold line 169 so that the central panels 141*a*, 141*b* are brought into face-to-face contact and can be adhesively attached, for example, along removable patches 181 disposed along the central panels 141*a*, 141*b* and the adhesive flap 127*a*.

The divider flaps 340*a*, 360*a* are positioned to divide the front interior space 190 of the front portion 106 of the carrier 305 into three container-receiving spaces 191 by extending from the central panel 141*a* to the front panel 115*a* and being adhesively connected to the front panel 115*a*. Similarly, the divider flaps 340*b*, 360*b* divide the back interior space 192 of the back portion 108 of the carrier 305 into three container-receiving spaces 193 by extending from the central panel 141*b* to the back panel 115*b* and being adhesively connected to the back panel 115*b*. In one embodiment, as illustrated, when the blank 303 is formed into the carrier 305, the attachment flap 362 in the central panel 141*b* of the back portion 109 of the blank 303 is adhesively attached to the central panel 141*a* of the front portion 107*a* when the central panels 141*a*, 141*b* are brought into face-to-face contact. The tear strips 371, 373, 375 of the blank 303 are positioned to form the line of weakening 310 (e.g., separation feature, tear strip, etc.) that extends across the top portion of the carrier 305.

Figure 16:
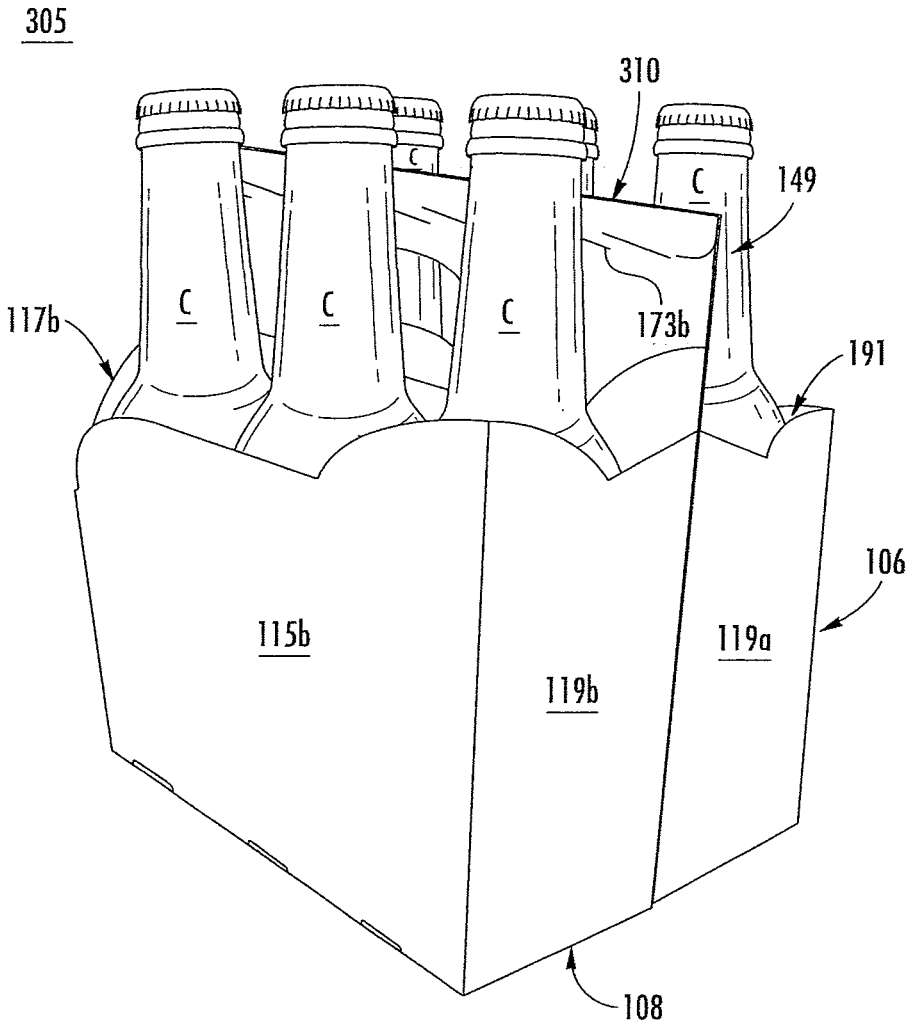
FIG. 16 is a perspective view of the carrier of FIG. 15 in a closed configuration and including containers.

Referring to FIGS. 8 and 16, the carrier 305 can be loaded with containers C and the bottom panels 138*a* and 155*a* can be overlapped to close the bottom of the front portion 106 of the carrier 305 and the bottom panels 138*b* and 155*b* can be overlapped to close the bottom of the back portion 108 of the carrier 305 so that the containers C are contained in the carrier 305 in a similar manner as described above with respect to carriers 105, 205.

Figure 17:
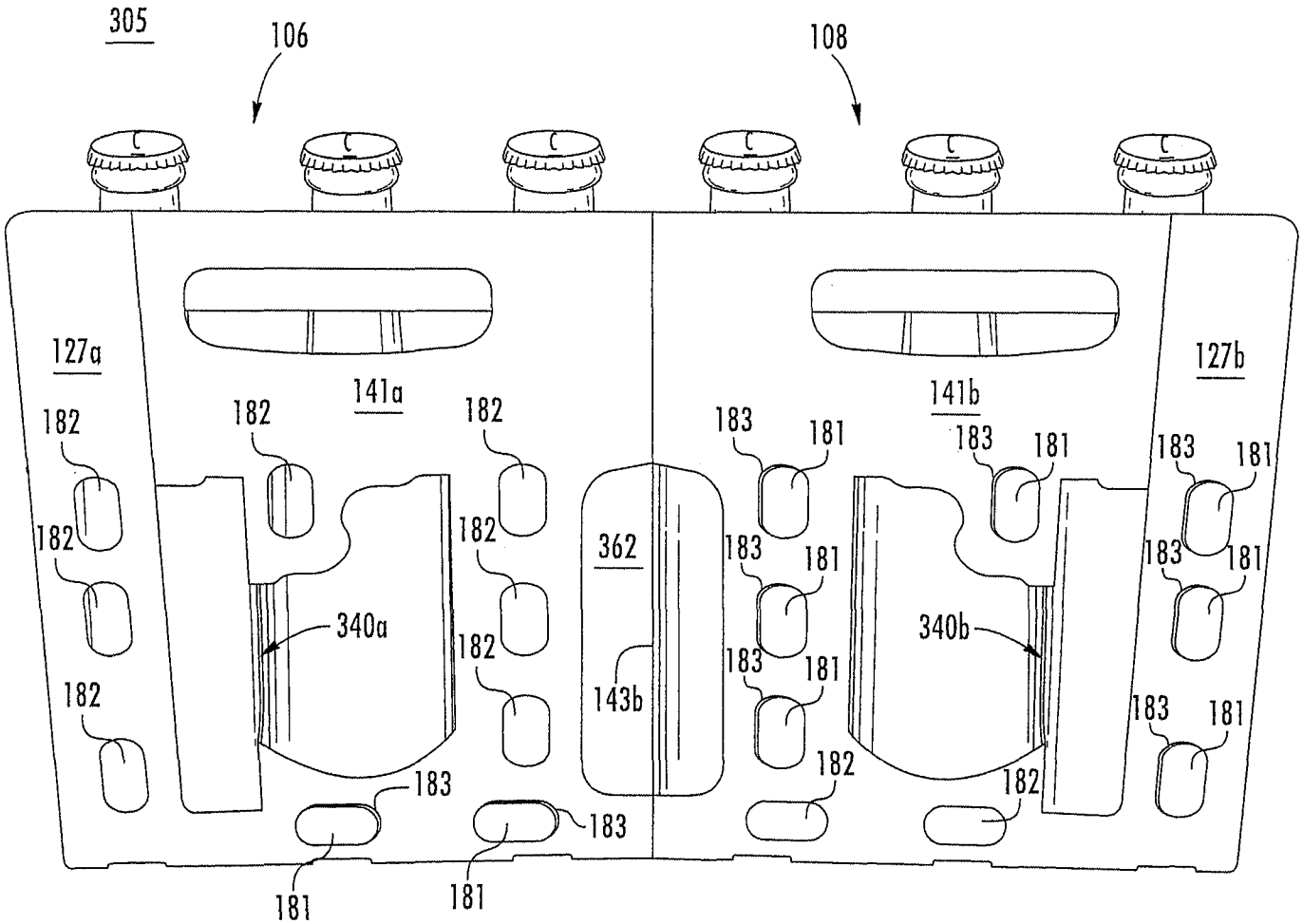
FIG. 17 is a perspective view of the carrier of FIG. 16 partially separated into a first portion and a second portion.

Referring to FIGS. 13 and 17, the tear strip 310 can be removed from the carrier 305 so that the front portion 106 and the back portion 108 of the carrier 305 can be pulled apart. Removable patches 181, as shown, may facilitate separation of the front portion 106 and the back portion 208 of the carrier 305 as described above with respect to carriers 105, 205. As shown in FIG. 17, the back portion 108 can remain attached to the front portion 106 by the adhesive attachment of the attachment flap 362 that is attached to the central panel 141*a* of the front portion 106 of the carrier 305. In this regard, upon breaching of the line of weakening 310, e.g., removal of the tear strips 371, 373, 375, the front portion 106 and the back portion 108 of the carrier 305 are hingably connected to one another via the attachment flap 362. As shown in FIG. 17, the front portion 106 and the back portion 108 of the carrier 305 can be positioned in a side-by-side relationship with the front portion 106 foldably connected to the back portion 108 and positioned in a 1×6 arrangement. The front portion 106 and back portion 108 of the carrier 305 can be otherwise positioned and could be free from foldable connection to each other so that front portion 106 and the back portion 108 are independently positionable in a refrigerator or on a display shelf. The carrier 305 can be formed by other steps and can have other features without departing from the disclosure.

FIGS. 18-22 illustrate a fourth exemplary embodiment of the disclosure similar to the first, second, and third embodiments, and like or similar reference numbers are indicated throughout the drawings to indicate like or similar features. The fourth embodiment of the carrier 405 is similar to the third embodiment 305, except that the fourth embodiment is a 2×2 configuration for holding four containers C, with two containers in the front portion 106 and two containers in the back portion 108. FIG. 18 illustrates a blank 403 for forming the carrier 405 of the fourth embodiment. The blank 403 includes a single divider flap 340*a* foldably connected to the central panel 141*a* at a fold line 341*a* in the front portion 107 of the blank 403 and a single divider flap 340*b* foldably connected to the central panel 141*b* at a fold line 341*b* in the back portion 109 of the blank 403. The divider flaps 340*a*, 340*b* divide the respective front interior space 190 of the front portion 106 and the back interior space 192 of the back portion 108 of the carrier 405 into two container-receiving spaces 191, 193.

Figure 19:
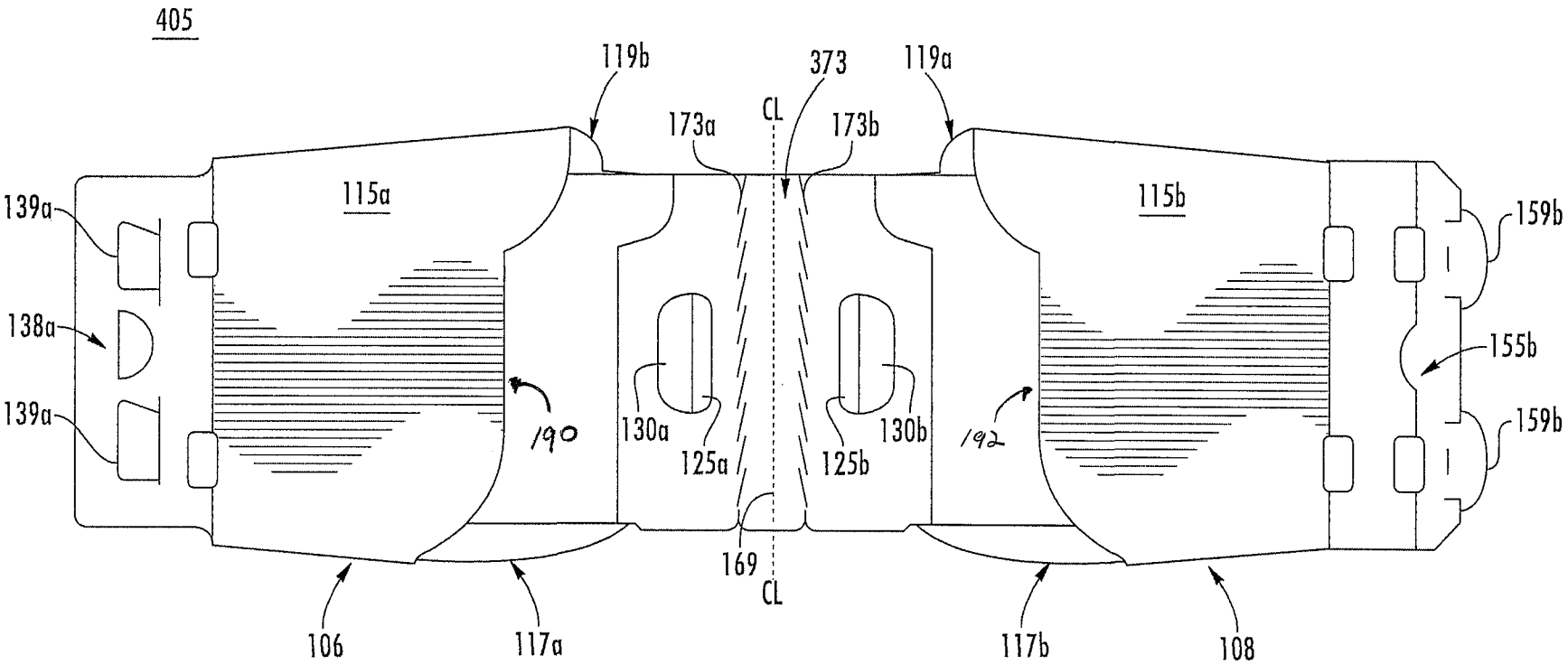
FIG. 19 is a perspective view of the blank of FIG. 18 in a partially folded configuration.
Figure 20:
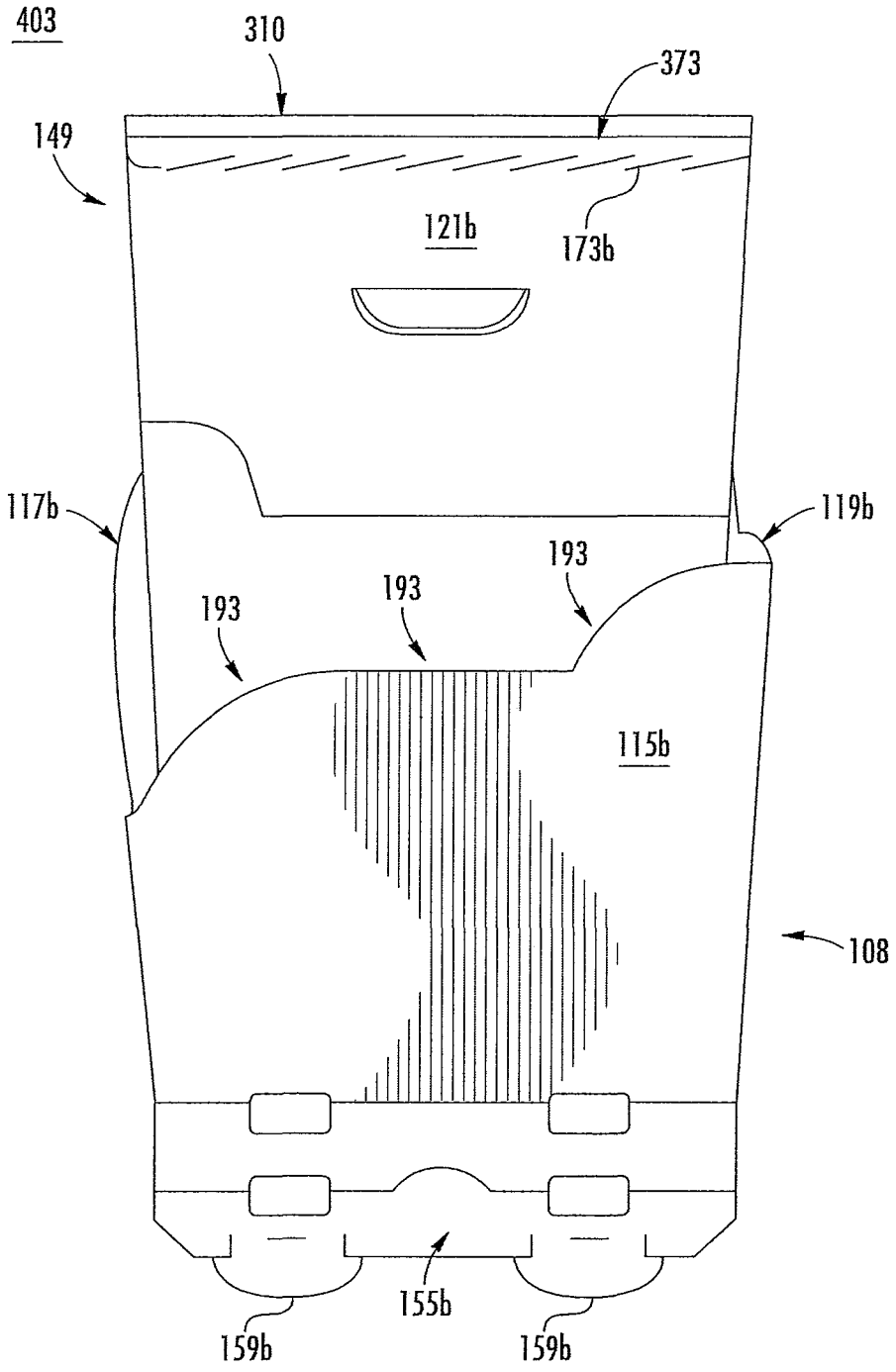
FIG. 20 is a perspective view of a carrier formed from the blank of FIG. 18 in an open configuration.

Still referring to FIG. 18, and referring additionally to FIGS. 19 and 20, the carrier 405 can be formed in a similar manner as the carrier 105 of the first embodiment, the carrier 205 of the second embodiment, and the carrier 305 of the third embodiment. In particular, the handle reinforcement flaps 121*a*, 121*b* can be folded along the fold lines 143*a*, 143*b* in the direction of A5 so that the handle reinforcement flaps 121*a*, 121*b* overlap the respective central panels 141*a*, 141*b*. The front panel 115*a* and back panel 115*b* can be folded about fold lines 143*a*, 143*b* to be brought into face-to-face contact with the respective central panels 141*a*, 141*b*. The adhesive flaps 127*a*, 127*b* are brought into face-to-face contact with the marginal portion of the respective central panels 141*a*, 141*b* and adhesively attached thereto, for example, by an adhesive. The front portion 106 and back portion 108 of the partially formed carrier 405 having respective open bottoms is folded about the central fold line 169 so that the central panels 141*a*, 141*b* are brought into face-to-face contact and can be adhesively attached, for example, along removable patches 181 disposed along the central panels 141*a*, 141*b* and the adhesive flap 127*a*.

Figure 21:
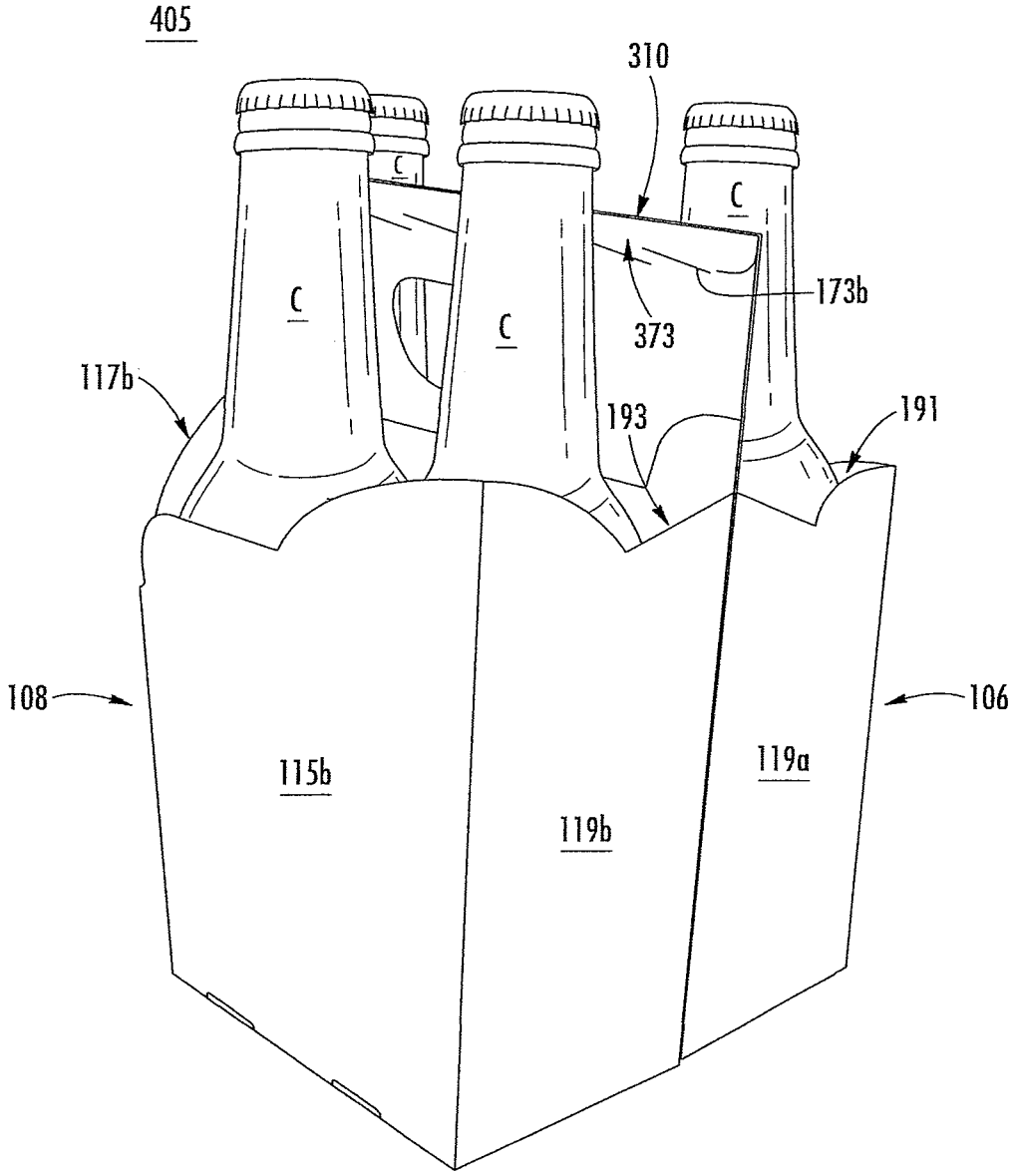
FIG. 21 is a perspective view of the carrier of FIG. 20 in a closed configuration and including containers.

Referring to FIGS. 20 and 21, the carrier 345 can be loaded with containers C and the bottom panels 138*a* and 155*a* can be overlapped to close the bottom of the front portion 106 of the carrier 405 and the bottom panels 138*b* and 155*b* can be overlapped to close the bottom of the back portion 108 of the carrier 305 so that the containers C are contained in the carrier 405 in a similar manner as described above with respect to carriers 105, 205, and 305.

Figure 22:
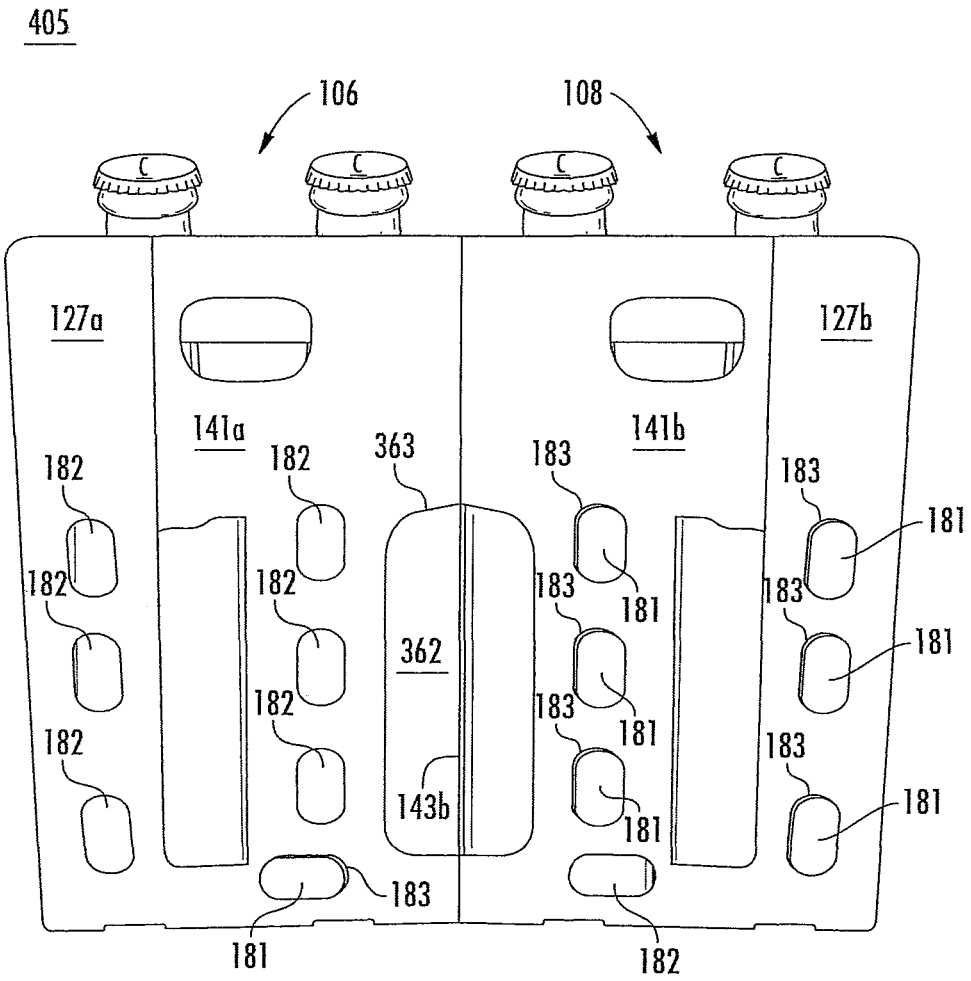
FIG. 22 is a perspective view of the carrier of FIG. 21 partially separated into a first portion and a second portion.

Referring to FIGS. 21 and 22, as with the third embodiment, the front portion 106 and the back portion 108 of the carrier 405 are separable by removal of the tear strip 310 that is comprised of the three tear strips 371, 373, 375 of the adhesive flaps 127*a*, 127*b*, the handle reinforcement flaps 121*a*, 121*b*, and the central panels 141*a*, 141*b*. Also, upon removal of the tear strip 310, the back portion 108 remains foldably connected to the front portion 106 by the attachment flap 362 that is secured to the central panel 141*a* of the front portion, for example, with adhesive G. As shown, the carrier 405 can be positioned in a 1×4 configuration with the front portion 106 and back portion 108 in a side-by-side arrangement. Alternatively, the front portion 106 and the back portion 108 of the carrier 405 could be separable without remaining foldably connected. The carrier 405 can be formed by other steps and can have other features without departing from the disclosure.

The carriers 105, 205, 305, 405 of the present disclosure allow the carriers to be loaded with containers C in the front and back portions 106, 108 of the carrier in a 2× configuration (e.g., 2×3, 2×2, etc., prior to separation) at a higher rate of container filler speed than if separate 1× carriers (e.g., 1×2, 1×3, etc.) are filled. The carriers 105, 205, 305, 405 are 2× carriers that can be separated into 1× carriers (corresponding to the separated front portion 106 and back portion 108) allows the container filler to be run at full speed when filling the 2× carriers. In this regard, the produced 2× carriers can be selectively separated post-processing according to the needs of a retailer or user. Also, the packaging machine running the 2× carriers 105, 205, 305, 405 can run at lower speeds to keep up with the same container filling speed than if 1× carriers were run thereby reducing wear and tear on the machine and components and increasing product filling line efficiency. The lower speeds available for the packaging machine running the 2× carriers are due to the fact that twice as many containers are being loaded into the 2× carriers than the 1× carriers. Thus, the higher rate of container filler speed and the reduced speeds of the packaging machine that the 2× carriers 105, 205, 305, 405 allow increase the efficiency in output of the packaging line that is used to package the containers C in the carriers.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a front portion that comprises a first plurality of panels at least partially surrounding a front interior space for receiving at least one container of the plurality of containers, the first plurality of panels comprising a front panel, a front central panel, and at least one front side panel; and a back portion that comprises a second plurality of panels at least partially surrounding a back interior space for receiving at least one container of the plurality of containers, the second plurality of panels comprising a back panel, a back central panel, and at least one back side panel, the front central panel and the back central panel are separably connected at a line of weakening comprising a tear line and are at least partially in face-to-face contact in a first configuration of the carrier, the carrier is positionable to a second configuration wherein the front portion and the back portion are at least partially separated at the line of weakening, wherein at least one of the front portion and the back portion comprises a removable patch being adhesively secured to the other of the at least one of the front portion and the back portion.

2. The carrier of claim 1, wherein the line of weakening comprises a tear strip at an upper portion of the carrier.

3. The carrier of claim 2, wherein the tear strip comprises an upper portion of each of the front central panel and the back central panel.

4. The carrier of claim 3, wherein the tear strip includes a central fold line on a centerline of the carrier.

5. The carrier of claim 1, wherein the removable patch is at least partially defined by a line of weakening.

6. The carrier of claim 5, wherein the front portion comprises a first removable patch and the back portion comprises a second removable patch, the first removable patch for being aligned with and in face-to-face contact with the second removable patch in the first configuration of the carrier.

7. The carrier of claim 6, wherein the first removable patch is adhesively connected to the second removable patch and the second removable patch is separated from the back portion in the second configuration of the carrier.

8. The carrier of claim 7, wherein the back portion comprises an opening in the second configuration defined by the line of weakening defining the second removable patch.

9. The carrier of claim 1, further comprising a handle comprising a front handle portion extending from the front central panel and a back handle portion extending from the back central panel.

10. The carrier of claim 9, wherein the handle comprises a front handle reinforcement flap and a back handle reinforcement flap respectively overlapped with a respective front handle portion and back handle portion.

11. The carrier of claim 10, wherein the front handle reinforcement flap and back handle reinforcement flap are foldably separably connected at a portion of the line of weakening.

12. The carrier of claim 1, wherein at least one of the front portion and the back portion comprises an attachment flap foldably connected to a respective one of the front central panel and the back central panel, the attachment flap being adhesively attached to the other of the front central panel and the back central panel, in the second configuration of the carrier, the front portion and the back portion remain foldably connected at the attachment flap.

13. The carrier of claim 1, wherein the front portion comprises at least one front divider flap foldably connected to at least one panel of the first plurality of panels, the front divider flap divides the front interior space into at least two front container-receiving spaces.

14. The carrier of claim 13, wherein the back portion comprises at least one back divider flap foldably connected to at least one panel of the second plurality of panels, the back divider flap divides the back interior space into at least two back container-receiving spaces.

15. The carrier of claim 14, wherein the at least one front divider flap is foldably connected to the front central panel and the at least one back divider flap is foldably connected to the back central panel.

16. The carrier of claim 15, wherein the at least one front divider flap comprises a first portion foldably connected to the front panel and a second portion foldably connected to the first portion and the front central panel, the front divider flap forms a window in the front portion.

17. The carrier of claim 13, wherein the at least one front divider flap comprises a first front divider flap foldably connected to the front central panel and a second front divider flap foldably connected to the front panel, the first front divider flap being adhesively connected to the second front divider flap.

18. The carrier of claim 1, wherein the first plurality of panels comprises a first front bottom panel foldably connected to the front panel and a second front bottom panel foldably connected to the front central panel.

19. The carrier of claim 18, wherein the second plurality of panels comprises a first back bottom panel foldably connected to the back central panel and a second back bottom panel foldably connected to the back panel.

20. The carrier of claim 19, wherein the first front bottom panel and the second front bottom panel cooperate to at least partially define the front interior space and the first back bottom panel and the second back bottom panel cooperate to at least partially define the back interior space.

* * * * *